US010782641B2

(12) United States Patent
Sekita

(10) Patent No.: US 10,782,641 B2
(45) Date of Patent: Sep. 22, 2020

(54) IMAGE FORMING APPARATUS AND IMAGE FORMING METHOD WHICH USE A POSITION DETECTION IMAGE AND A DENSITY DETECTION IMAGE

(71) Applicant: Ricoh Company, Ltd., Tokyo (JP)

(72) Inventor: Daiki Sekita, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/292,822

(22) Filed: Mar. 5, 2019

(65) Prior Publication Data

US 2019/0278210 A1 Sep. 12, 2019

(30) Foreign Application Priority Data

Mar. 7, 2018 (JP) ..... 2018-041003

(51) Int. Cl.
*G03G 15/00* (2006.01)
*G03G 15/16* (2006.01)
*G03G 15/20* (2006.01)

(52) U.S. Cl.
CPC ..... *G03G 15/5062* (2013.01); *G03G 15/1605* (2013.01); *G03G 15/2064* (2013.01);
(Continued)

(58) Field of Classification Search
CPC ..... G03G 15/5062; G03G 15/55; G03G 15/6573; G03G 15/2064; G03G 15/1605;
(Continued)

(56) References Cited

U.S. PATENT DOCUMENTS 6,961,526 B2 * 11/2005 Tezuka ..... G03G 15/5062 399/15
2002/0113856 A1 * 8/2002 Suzuki ..... H04N 1/4015 347/133

(Continued)

FOREIGN PATENT DOCUMENTS

JP 2005-283898 10/2005
JP 2007316237 A 12/2007

(Continued)

OTHER PUBLICATIONS

European Search Report dated Aug. 12, 2019, issued in corresponding European Patent Application No. 19161035.1, 9 pages.

*Primary Examiner* — Walter L Lindsay, Jr.
*Assistant Examiner* — Laura Roth
(74) *Attorney, Agent, or Firm* — XSENSUS LLP

(57) ABSTRACT

An image forming apparatus includes an image forming device, an image position detector, and an image density detector. The image forming device forms an image on a surface of a recording medium. The image position detector detects a position of the image. The image density detector detects a density of the image. The image forming device forms a position detection image on a surface of a first recording medium. The image position detector detects a position of the position detection image on the surface of the first recording medium. The image forming device forms a density detection image on a second recording medium. The image density detector detects a density of the density detection image on the surface of the second recording medium.

16 Claims, 14 Drawing Sheets

(52) U.S. Cl.
CPC ..... *G03G 15/55* (2013.01); *G03G 15/6573* (2013.01); *G03G 2215/00067* (2013.01); *G03G 2215/00569* (2013.01); *G03G 2215/00721* (2013.01); *G03G 2215/00755* (2013.01); *G03G 2215/0129* (2013.01); *G03G 2215/0161* (2013.01)

(58) Field of Classification Search
CPC . G03G 2215/00569; G03G 2215/0161; G03G 2215/00755; G03G 2215/0129; G03G 2215/00721; G03G 2215/00067
See application file for complete search history.

(56) References Cited

U.S. PATENT DOCUMENTS

2005/0041988 A1* 2/2005 Kaneko ..... G03G 15/5095 399/45
2005/0271404 A1* 12/2005 Iwakawa ..... G03G 15/5062 399/49
2008/0025777 A1* 1/2008 Nagel ..... G03G 15/5062 399/396
2010/0189447 A1* 7/2010 Ishizuka ..... G03G 15/5062 399/15
2010/0225932 A1* 9/2010 Kurose ..... G03G 15/0131 358/1.1
2011/0135363 A1* 6/2011 Funayanagi ..... B65H 29/242 399/397
2012/0097872 A1 4/2012 Ito et al.
2012/0099873 A1* 4/2012 Ninomiya ..... G03G 15/04036 399/15
2013/0083107 A1* 4/2013 Nishikawa ..... B41J 2/0451 347/10
2017/0038719 A1 2/2017 Takemura et al.
2017/0131671 A1 5/2017 Nishimura et al.
2017/0315486 A1* 11/2017 Takemura ..... G03G 15/011

FOREIGN PATENT DOCUMENTS

JP 2011-022363 2/2011
JP 2012203063 A 10/2012

* cited by examiner

IMAGE FORMING APPARATUS AND IMAGE FORMING METHOD WHICH USE A POSITION DETECTION IMAGE AND A DENSITY DETECTION IMAGE

CROSS-REFERENCE TO RELATED APPLICATION

This patent application is based on and claims priority pursuant to 35 U.S.C. § 119(a) to Japanese Patent Application No. 2018-041003, filed on Mar. 7, 2018, in the Japan Patent Office, the entire disclosure of which is incorporated by reference herein.

BACKGROUND

Technical Field

Aspects of the present disclosure relate to an image forming apparatus and an image forming method.

Related Art

There have been known image information detecting devices including an image density detector that detects an image density of an image on a surface of an image bearer.

For example, an image information detecting device of this type includes a color sensor (image density detector) that detects an image density of a color patch (a density detection image) after fixation formed on a recording paper (image bearer) by an image forming apparatus.

SUMMARY

In an aspect of the present disclosure, there is provided an image forming apparatus that includes an image forming device, an image position detector, and an image density detector. The image forming device forms an image on a surface of a recording medium. The image position detector detects a position of the image. The image density detector detects a density of the image. The image forming device forms a position detection image on a surface of a first recording medium. The image position detector detects a position of the position detection image on the surface of the first recording medium. The image forming device forms a density detection image on a second recording medium. The image density detector detects a density of the density detection image on the surface of the second recording medium.

In another aspect of the present disclosure, there is provided an image forming method that includes forming a position detection image on a surface of a first recording medium with an image forming device; detecting a position of the position detection image on the surface of the first recording medium with an image position detector; forming a density detection image on a second recording medium with the image forming device; and detecting a density of the density detection image on the surface of the second recording medium with the image density detector.

According to the present invention, there is an excellent effect of preventing false detection of an image density caused by deviation of a position of an image with respect to an image bearer.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
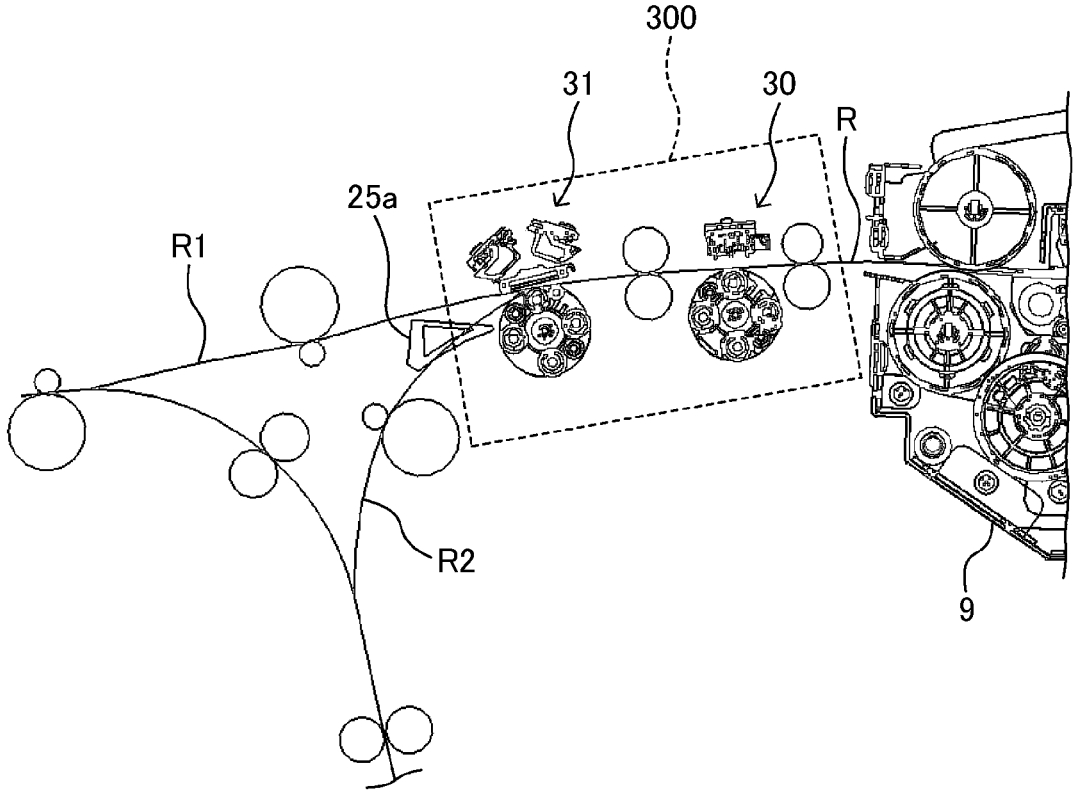
FIG. 1 is a schematic explanatory view of a vicinity of an image information detecting device.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, an example of an electrophotographic copying machine (hereinafter simply referred to as "copying machine 500") will be described as an image forming apparatus according to an embodiment of the present disclosure.

First, a basic configuration of the copying machine 500 according to the present embodiment will be described.

Figure 2:
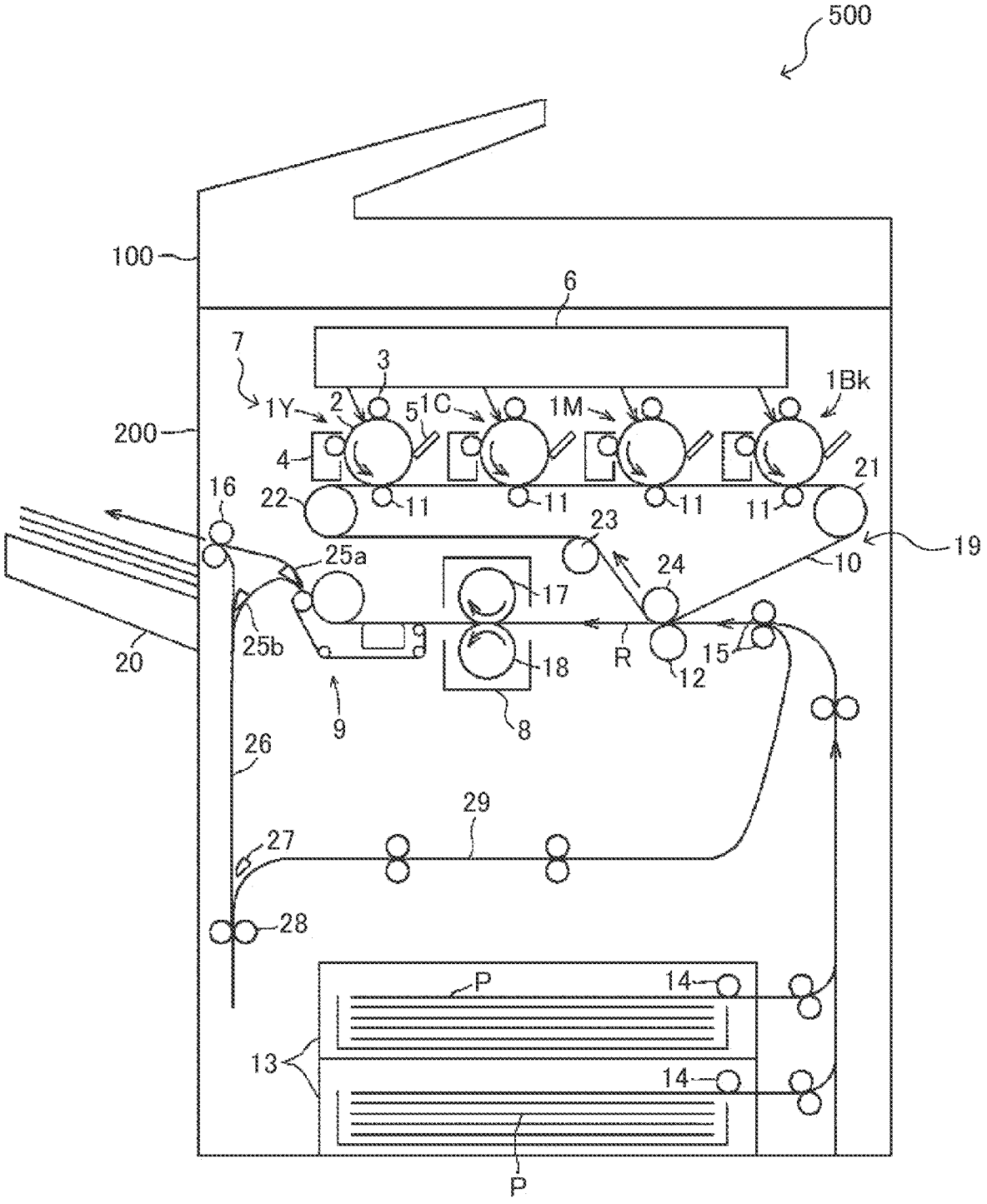
FIG. 2 is a schematic configuration diagram of a copying machine.

FIG. 2 is a schematic configuration diagram of the copying machine 500. As illustrated in FIG. 2, the copying machine 500 includes a printer 200 that forms an image on a recording material P as a recording medium and outputs the recording medium to an ejection tray 20 outside the apparatus, and a scanner 100 as an image reader arranged above the printer 200.

The copying machine 500 in FIG. 2 includes a tandem image forming device 7 in which four process units 1 (Y, C, M, and Bk) as image forming units are arranged side by side. Each of the four process units 1 (Y, C, M, and Bk) is attachable and detachable to and from the printer 200. Further, the four process units 1 (Y, C, M, and Bk) have a similar configuration except that the four process units 1 use toners of different colors of yellow (Y), cyan (C), magenta (M), and black (Bk) corresponding to color separation components of a color image. Therefore, description will be given omitting the suffixes (Y, C, M, and Bk) indicating the colors of the toners to be used.

The process unit 1 includes a drum-shaped photoconductor 2 as a latent image bearer, a charging roller 3, a developing device 4, and a cleaning blade 5. The charging roller 3 is a charger that charges a surface of the photoconductor 2. The developing device 4 is a developing device that forms a toner image on the surface of the photoconductor 2. The cleaning blade 5 is a cleaner that cleans the surface of the photoconductor 2. In FIG. 2, the photoconductor 2, the charging roller 3, the developing device 4, and the cleaning blade 5 included in a yellow process unit 1Y are denoted by reference numerals, and reference numerals are omitted for the other process units 1 (C, M, and Bk).

In FIG. 2, the image forming device 7 includes an exposure device 6 as an exposure device that exposes the surface of the photoconductor 2 above the four process units 1 (Y, C, M, and Bk). The exposure device 6 includes a light source, a polygon mirror, an f-θ lens, a reflecting mirror, and the like, and irradiates the surface of each of the four photoconductors 2 with laser light on the basis of image data.

A transfer device 19 is arranged below the four process units 1 (Y, C, M, and Bk). The transfer device 19 includes an intermediate transfer belt 10 as a transfer member formed of an endless belt. The intermediate transfer belt 10 is stretched around a plurality of stretching rollers (21 to 24) as supporting members. The intermediate transfer belt 10 circles (rotates) in a direction (clockwise direction) indicated by the arrow in FIG. 2 as one of the stretching rollers (21 to 24) rotates as a driving roller.

Four primary transfer rollers 11 as a primary transfer device are respectively arranged at positions facing the four photoconductors 2 across the intermediate transfer belt 10. The four primary transfer rollers 11 press an inner peripheral surface of the intermediate transfer belt 10 at the respective positions, and primary transfer nips are formed at places where pressed portions of the intermediate transfer belt 10 and the respective photoconductors 2 are in contact with one another. Each of the primary transfer rollers 11 is connected to a power supply, and at least one of a predetermined direct current voltage (DC) and a predetermined alternating current voltage (AC) is applied to the primary transfer roller 11.

A secondary transfer roller 12 as a secondary transfer device is arranged at a position facing a secondary transfer counter roller 24 across the intermediate transfer belt 10, the secondary transfer counter roller 24 being one of the stretching rollers stretching the intermediate transfer belt 10. The secondary transfer roller 12 presses an outer peripheral surface of the intermediate transfer belt 10, and a secondary transfer nip is formed at a place where the secondary transfer roller 12 and the intermediate transfer belt 10 are in contact with each other. The secondary transfer roller 12 is connected to a power supply, similarly to the primary transfer rollers 11, and at least one of a predetermined direct current voltage (DC) and a predetermined alternating current voltage (AC) is applied to the secondary transfer roller 12.

A plurality of sheet feeding cassettes 13 each accommodating the recording material P as a sheet-like recording medium such as a paper or an overhead projector (OHP) sheet is arranged in a bottom portion of the printer 200. The image forming apparatus according to an embodiment of the present disclosure may form an image on a continuous recording medium wound in a roll manner as the recording medium.

Each sheet feeding cassette 13 is provided with a sheet feeding roller 14 that feeds the accommodated recording material P. The printer 200 is provided with the ejection tray 20 as a sheet ejector that stocks the recording material P ejected outside the printer 200.

A conveyance path R for conveying the recording material P from the sheet feeding cassette 13 through the secondary transfer nip to the ejection tray 20 is arranged in the printer 200. A registration roller pair 15 is arranged on an upstream side in a recording material conveyance direction with respect to the position of the secondary transfer roller 12 in the conveyance path R. Further, a fixing device 8 that heats an unfixed image to be fixed to the recording material P, a cooling device 9, and an ejection roller pair 16 including a pair of roller members are sequentially arranged on a downstream side in the recording material conveyance direction with respect to the position of the secondary transfer roller 12.

The fixing device 8 includes, for example, a fixing roller 17 as a fixing member including a heater (heat source) inside, and a pressure roller 18 as a pressure member that pressurizes the fixing roller 17. A fixing nip is formed at a place where the fixing roller 17 and the pressure roller 18 are in contact with each other. The configuration of the fixing device is not limited to a system in which the fixing member and the pressure member are both roller members, and may be a belt system in which at least one of the fixing member and the pressure member is a belt member.

Hereinafter, a basic operation of the copying machine 500 will be described referring to FIG. 2.

When an image forming operation is started, the photoconductor 2 of each of the process units 1 (Y, C, M, and Bk) is rotationally driven in a counterclockwise direction in FIG. 2, and the surface of the photoconductor 2 is uniformly charged to have a predetermined polarity by the charging roller 3. The exposure device 6 irradiates the charged surface of each of the photoconductors 2 with the laser light on the basis of image information of a document read by the scanner 100 or print information given in instruction to be printed from an input terminal such as a personal computer. With the irradiation, an electrostatic latent image is formed on the surface of each of the photoconductors 2.

The image information for exposing the surface of each of the photoconductors 2 by the exposure device 6 is monochrome image information obtained by decomposing a desired full color image into color information of yellow, cyan, magenta, and black. The electrostatic latent image is visualized into an image as a toner image when a toner is supplied to the electrostatic latent image on the photoconductor 2 by the developing device 4.

The stretching rollers stretching the intermediate transfer belt 10 are rotationally driven to circle the intermediate transfer belt 10 in the direction of the arrow (clockwise direction) in FIG. 2. Further, transfer electric fields are formed in the primary transfer nips between the four primary transfer rollers 11 and the four photoconductors 2 as voltages are respectively applied to the four primary transfer rollers 11, the voltages having been constant-voltage controlled or constant-current controlled and having opposite polarities to charged polarities of the toners. Then, toner images of the colors on the photoconductors 2 are sequentially transferred onto the intermediate transfer belt 10 in a superimposed manner by the transfer electric fields formed in the respective primary transfer nips. In this manner, a full-color toner image is formed on the surface of the intermediate transfer belt 10, and the intermediate transfer belt 10 carries the toner image. The toner on the photoconductors 2, which could not be transferred to the intermediate transfer belt 10, is removed by the cleaning blade 5.

One recording material P is carried out from one of the sheet feeding cassettes 13 as the sheet feeding roller 14 rotates. The carried-out recording material P passes through the registration roller pair 15 and is sent to the secondary transfer nip between the secondary transfer roller 12 and the intermediate transfer belt 10. At this time, since the transfer voltage having an opposite polarity to the charged polarity of the toner of the toner image on the intermediate transfer belt 10 is applied to the secondary transfer roller 12, the transfer electric field is formed in the secondary transfer nip.

The toner images on the intermediate transfer belt 10 are collectively transferred to the recording material P by the transfer electric field formed in the secondary transfer nip. After that, the recording material P is sent to the fixing device 8 and is pressurized and heated by the fixing roller 17 and the pressure roller 18, and the toner images are fixed to the recording material P. Then, after cooled by the cooling device 9, the recording material P is ejected to the ejection tray 20 by the ejection roller pair 16.

In a case of double-sided printing, a first switching claw 25*a* and a second switching claw 25*b* are switched to guide the cooled recording material P to a reversing path 26. After that, a reversing switching claw 27 is switched to reversely rotate a reversing roller pair 28, and the reversed recording material P is re-fed from a back surface transfer conveyance path 29 to the registration roller pair 15 to reverse the front and back sides of the recording material. At this time, a toner image as a back-side image is formed and carried on the intermediate transfer belt 10 and is transferred to a second side of the recording material P, and the recording material P undergoes fixing processing by the fixing device 8 and cooling processing by the cooling device 9 and is ejected onto the ejection tray 20 by the ejection roller pair 16.

The above description is an image forming operation when a full color image is formed on the recording material P. The copying machine 500 can form a monochrome image using any one of the four process units 1 (Y, C, M, and Bk) or can form a two-color image or a three-color image using two or three of the process units 1.

Furthermore, in a case where the printer 200 has a configuration including five or more process units 1, the printer 200 can form a multicolor image using the five or more process units 1.

FIG. 1 is a schematic explanatory view of a vicinity of an image information detecting device 300 arranged on a downstream side in the conveyance direction of the recording material P with respect to the cooling device 9 in the printer 200 of the copying machine 500 illustrated in FIG. 2.

As illustrated in FIG. 1, the printer 200 includes the image information detecting device 300 on a downstream side of the cooling device 9 in the conveyance direction of the recording material P in the conveyance path R and on an upstream side of the first switching claw 25*a*.

The image information detecting device 300 includes a density detection sensor 31 as an image density detector that detects a density of an image on the surface of the recording material P. Further, the image information detecting device 300 includes a position detection sensor 30 as an image position detector that detects a position of an image on the surface of the recording material P. The position detection sensor 30 is arranged on an upstream side of the density detection sensor 31.

The position of the toner image on the recording material P sometimes deviates with respect to an ideal printing position on the surface of the recording material P due to a conveyance posture of the recording material P or an influence such as thermal contraction of when the recording material P passes through the fixing device 8 and the cooling device 9. The position detection sensor 30 in the copying machine 500 detects the positional deviation of the image and feeds back a deviation amount (position detection result) to the control of the image forming device such as the image forming device 7.

Further, in the toner image on the recording material P, a print output characteristic changes with change of a print environment or progress of printing, and a desired print characteristic (image density) may not be obtained. In the copying machine 500, the density detection sensor 31 reads a color patch of a density detection mark and feeds back a detection result regarding an obtained print characteristic to the control of the image forming device such as the image forming device 7, similarly to the position detection result.

The printer 200 according to the present embodiment forms a position detection mark and a density detection mark on the recording material P as image information detection images, detects the position and density of the image information detection images using the image information detecting device 300, and corrects an image forming condition using detection results. The output image information detection images are detected and the image forming condition is corrected, as described above, to perform color calibration to calibrate a tone.

Here, conventional color calibration will be described.

Figure 14A:
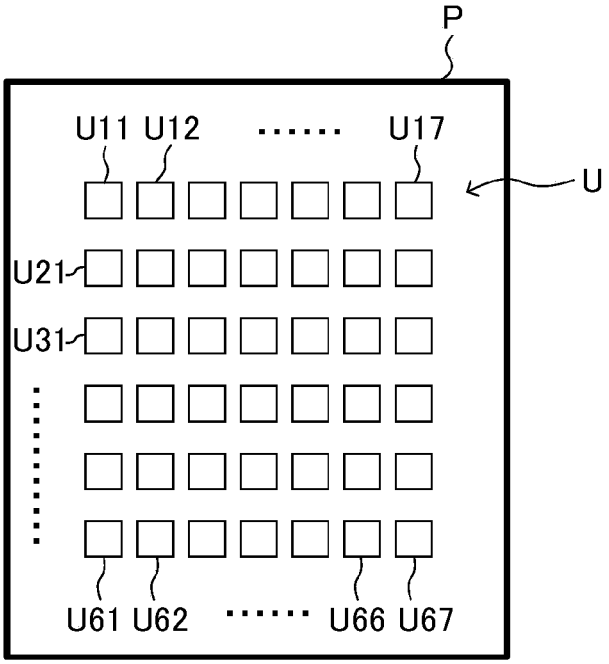
FIGS. 14A to 14C are explanatory views of problems that may arise in conventional color calibration.
Figure 14B:
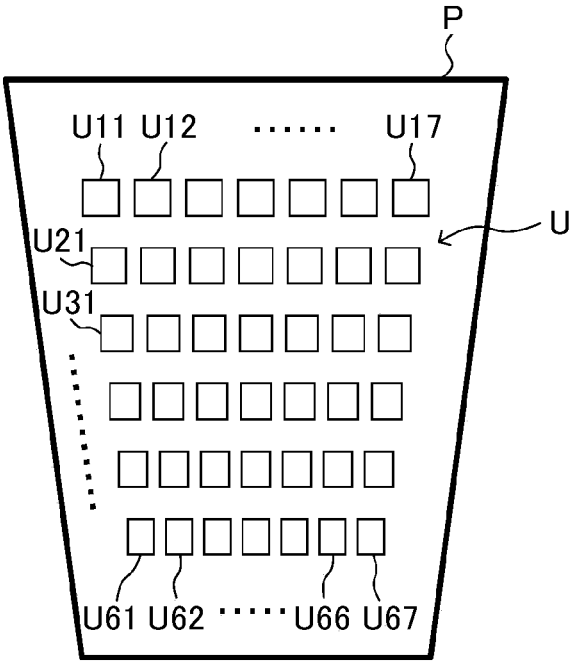
Figure 14C:
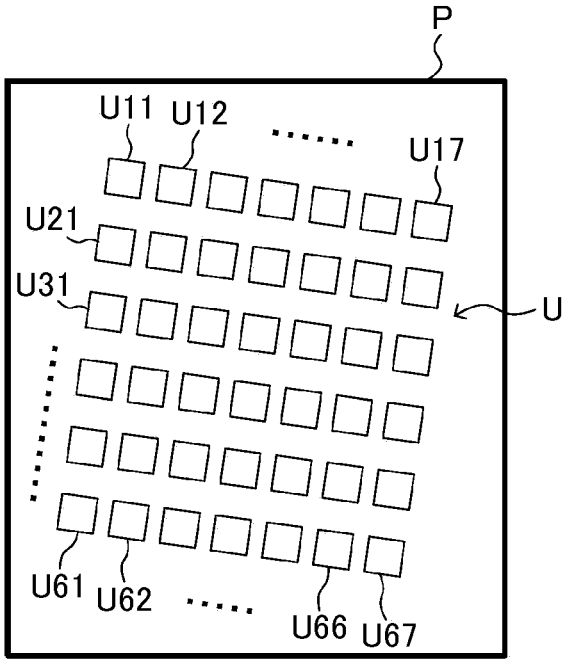

FIGS. 14A to 14C are explanatory views of problems that may arise in the conventional color calibration. FIG. 14A is an explanatory view illustrating a state in which a density detection mark U is formed at an appropriate position on the recording material P Further, FIGS. 14B and 14C are explanatory views illustrating a state in which the density detection mark U is not formed at an appropriate position on the recording material P.

The density detection sensor acquires image information at a predetermined position on the surface of the recording material P. As illustrated in FIG. 14A, when the density detection mark U is formed at an appropriate position on the recording material P, each patch ("U11 to U67") is at a corresponding predetermined position, and detection of the image density of each coordinates enables detection of the image density of a patch to be detected.

FIG. 14B illustrates a state in which the width of the density detection mark U becomes smaller on a rear end side (a lower side in FIG. 14B) of the recording material P than on a leading end side (an upper side in FIG. 14B) because the thermal contraction of when the recording material P passes through the fixing device 8 and the cooling device 9 differs between on the leading end side and on the rear end side. In the state illustrated in FIG. 14B, the positions of the patches ("U11 to U67") deviate from corresponding predetermined positions. For example, the adjacent patch "U61" is located at a place where the patch "U62" is supposed to locate. If the image density is detected in this state, there is a possibility that the image density of the patch "U61" having a different density from the patch "U62" is falsely detected as the image density of the patch "U62".

The deviation of the image position due to the thermal contraction is not limited to the case where the thermal contraction differs between on the leading end side and on the rear end side. When the entire recording material P becomes smaller due to the thermal contraction than the recording material P at the time of transfer, the position of each patch forming the density detection mark U deviates from a corresponding predetermined position. Then, the image density of another patch having a different image density from a patch to be detected may be falsely detected as the image density of the patch to be detected.

FIG. 14C illustrates a state in which the density detection mark U is inclined with respect to the recording material P. Even in the state illustrated in FIG. 14C, the positions of the patches ("U11 to U67") deviate from the corresponding predetermined positions. For example, the adjacent patch "U11" is located at a place where the patch "U12" is supposed to locate. If the image density is detected in this state, there is a possibility that the image density of the patch "U11" having a different density from the patch "U12" is falsely detected as the image density of the patch "U12".

If the image forming condition is corrected on the basis of these false detections, there is a possibility that an appropriate image density cannot be obtained.

Figure 3:
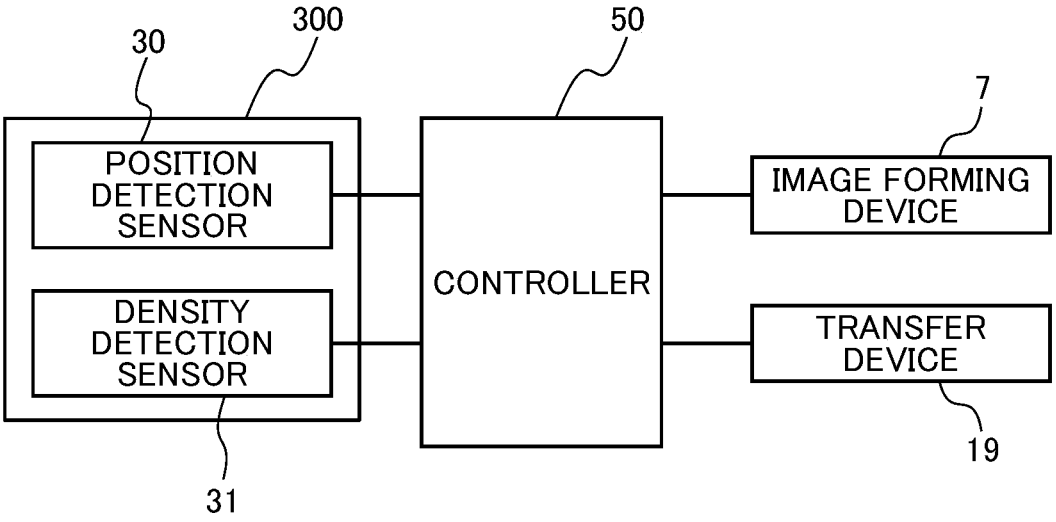
FIG. 3 is a block diagram of a control system that performs color calibration according to an embodiment of the present disclosure.

FIG. 3 is a block diagram of a control system that performs color calibration according to the present embodiment.

Figure 4A:
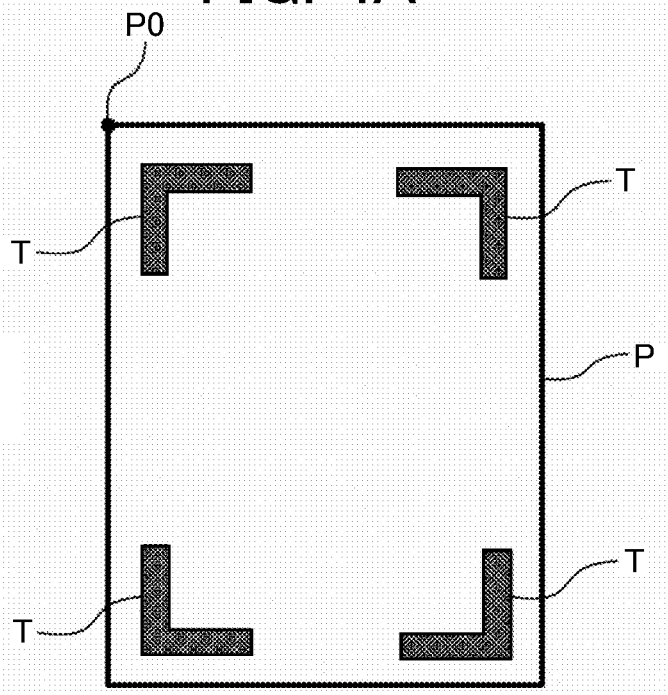
FIGS. 4A and 4B are explanatory views of examples of an image information detection image formed on a recording material.
Figure 4B:
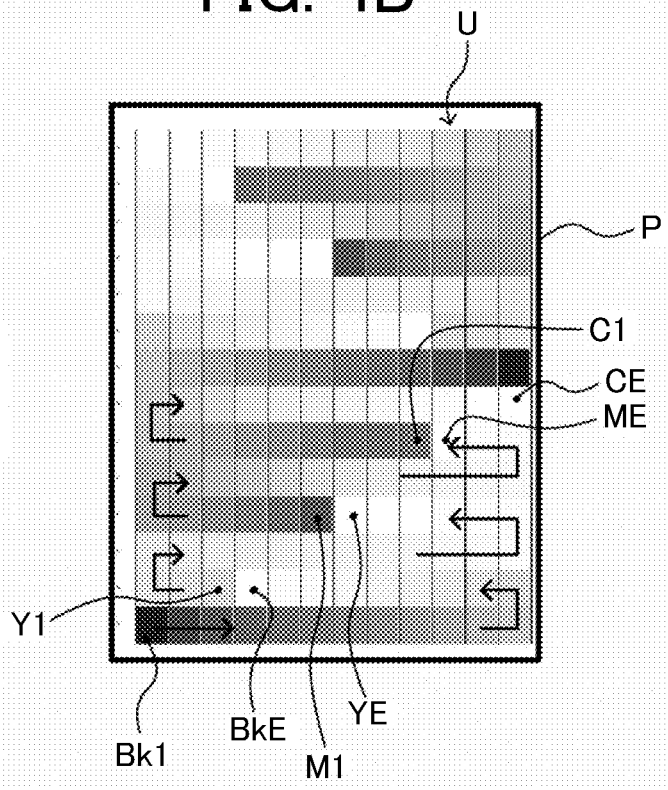

FIGS. 4A and 4B are explanatory views of examples of an image information detection image formed on the recording material P. In the example illustrated in FIGS. 4A and 4B, a position detection mark T and the density detection mark U are formed on different recording materials P. FIG. 4A is an explanatory view of the recording material P on which the position detection mark T is formed, and FIG. 4B is an explanatory view of the recording material P on which the density detection mark U is formed.

The density detection mark U illustrated in FIG. 4B has 14 color patches in a longitudinal direction and 12 color patches in a cross direction. Patches having different densities of 21 gradations are formed twice for each of the four color. Taking black as an example, the patch indicated by "Bk1" in FIG. 4B is a solid image with the highest density, the density becomes lower toward the patches indicated by the "arrow", and the patch indicated by "BkE" is an image with the lowest density. Similarly for yellow, magenta, and cyan, and the patches indicated by "Y1", "M1", and "C1" are patches with the highest density, the density becomes lower toward the patches indicated by the "arrow", and the patches indicated by "YE", "ME", and "CE" are images with the lowest density.

The density detection sensor 31 detects the image density at a predetermined position at predetermined timing, thereby to detect the image density of the color patch to be detected at a predetermined position on the recording material P passing through a detection region.

When performing the color calibration, a controller 50 controls the image forming device 7 and the transfer device 19 to first form the position detection mark T illustrated in FIG. 4A on the recording material P and detects the position detection mark T by the position detection sensor 30. In a case where the position detection mark T is not at a desired position with respect to a recording material origin P0, the controller 50 changes the image forming conditions of the image forming device 7 and the transfer device 19, and repeatedly performs feedback control until the position detection mark T reaches the desired position with respect to the recording material origin P0. When detecting that the position detection mark T reaches the desired position with respect to the recording material origin P0, the controller 50 forms the density detection mark U illustrated in FIG. 4B on the recording material P and detects the image density by the density detection sensor 31.

Figure 5:
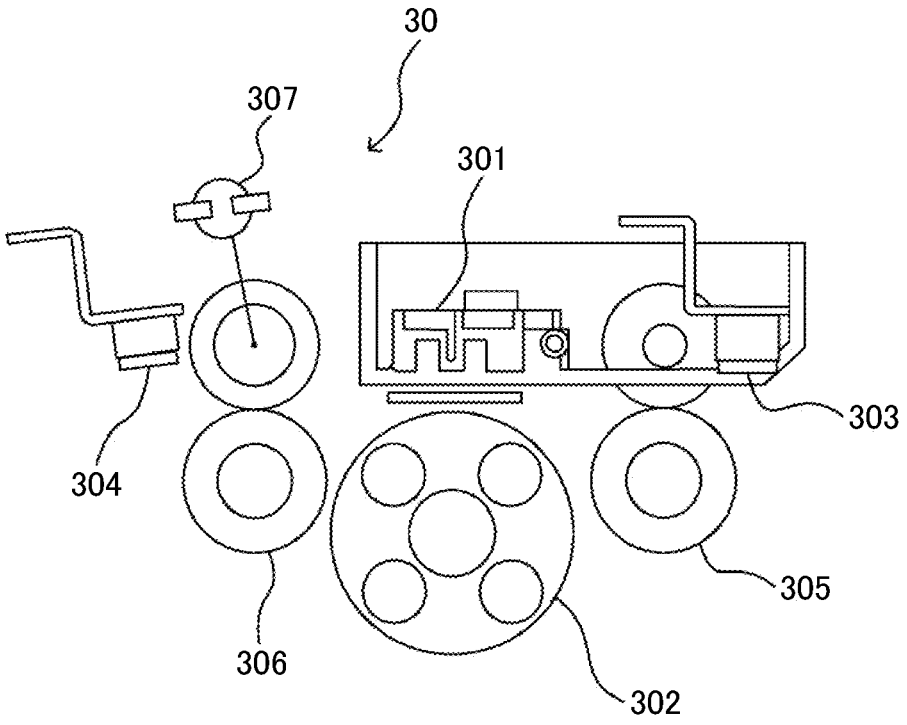
FIG. 5 is a schematic explanatory diagram of a position detection sensor.

FIG. 5 is a schematic explanatory diagram of the position detection sensor 30. The position detection sensor 30 includes a contact image sensor (CIS) 301 extending in a width direction (a direction orthogonal to the sheet surface in FIG. 5), and a position detection shading mechanism 302. Further, the position detection sensor 30 includes a position detection upstream trigger sensor 303 and a position detection downstream trigger sensor 304. The position detection sensor 30 includes a position detection upstream conveyance roller pair 305 between the position detection upstream trigger sensor 303 and the CIS 301 and a position detection downstream conveyance roller pair 306 between the position detection downstream trigger sensor 304 and the CIS 301. The position detection sensor 30 is an image reading device of an equal magnification optical system.

Furthermore, the position detection sensor 30 includes an encoder 307 that detects the number of rotations of the position detection downstream conveyance roller pair 306. The controller 50 grasps the position of the recording material P by the position detection upstream trigger sensor 303 and the position detection downstream trigger sensor 304, and calculates a moving amount of the recording material P on the basis of the number of rotations of the position detection downstream conveyance roller pair 306 detected by the encoder 307.

Figure 6:
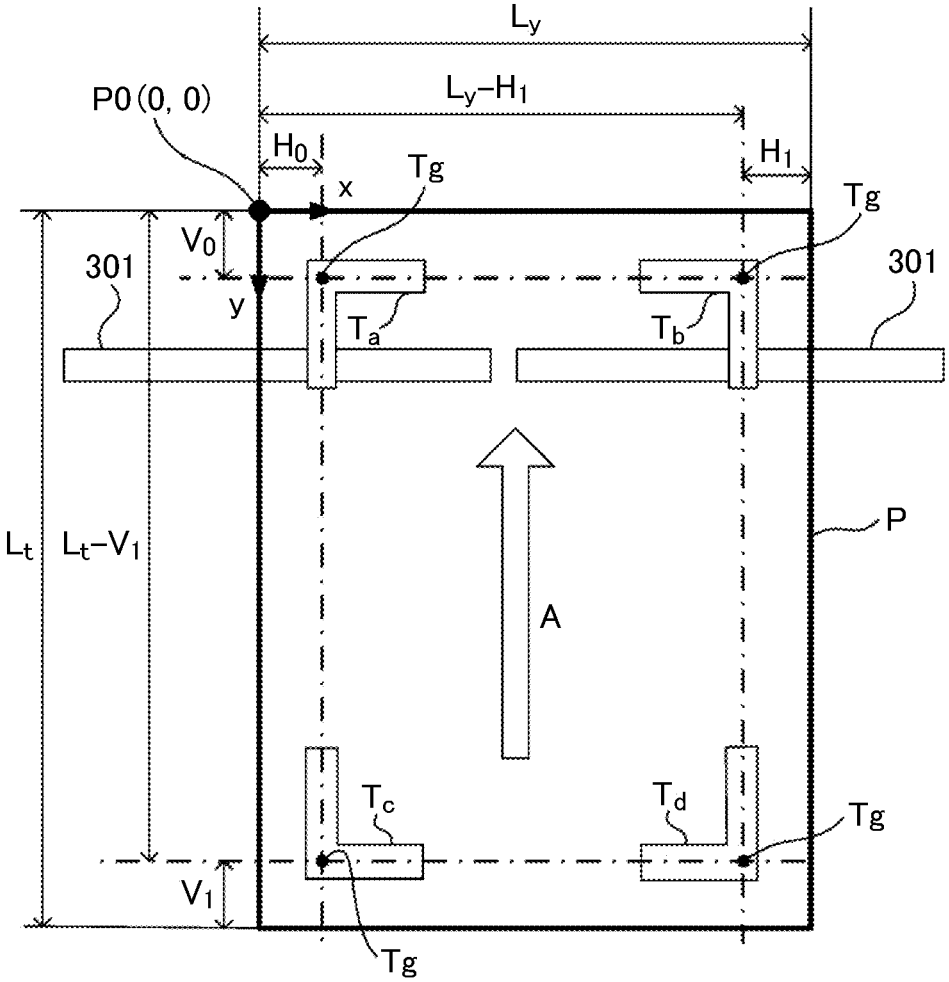
FIG. 6 is an explanatory diagram of a CIS of a position detection sensor and a position detection mark on a recording material.

FIG. 6 is an explanatory diagram of the CIS 301 of the position detection sensor 30 and the position detection mark T on the recording material P. As illustrated in FIG. 6, the position detection sensor 30 of the present embodiment includes two CISs 301. When the recording material P passes through the detection region of the position detection sensor 30, the two CISs 301 detect four position detection marks T (Ta, Tb, Tc, and Td) transferred on the recording material P. Then, the position detection sensor 30 calculates coordinates of a detection mark center position Tg of an individual position detection mark T, where the coordinates of the recording material origin P0 are (0, 0), and feeds back a deviation amount from ideal coordinates to the image forming device 7, thereby to correct the image position. As the feedback of the deviation amount, the deviation amount can be fed back by correcting a writing position of the exposure device 6.

The position of a left front corner of the recording material P serving as the recording material origin P0 is specified by calculating a front edge side and a left edge side of the recording material P and calculating a point where these two sides intersect.

Figure 7:
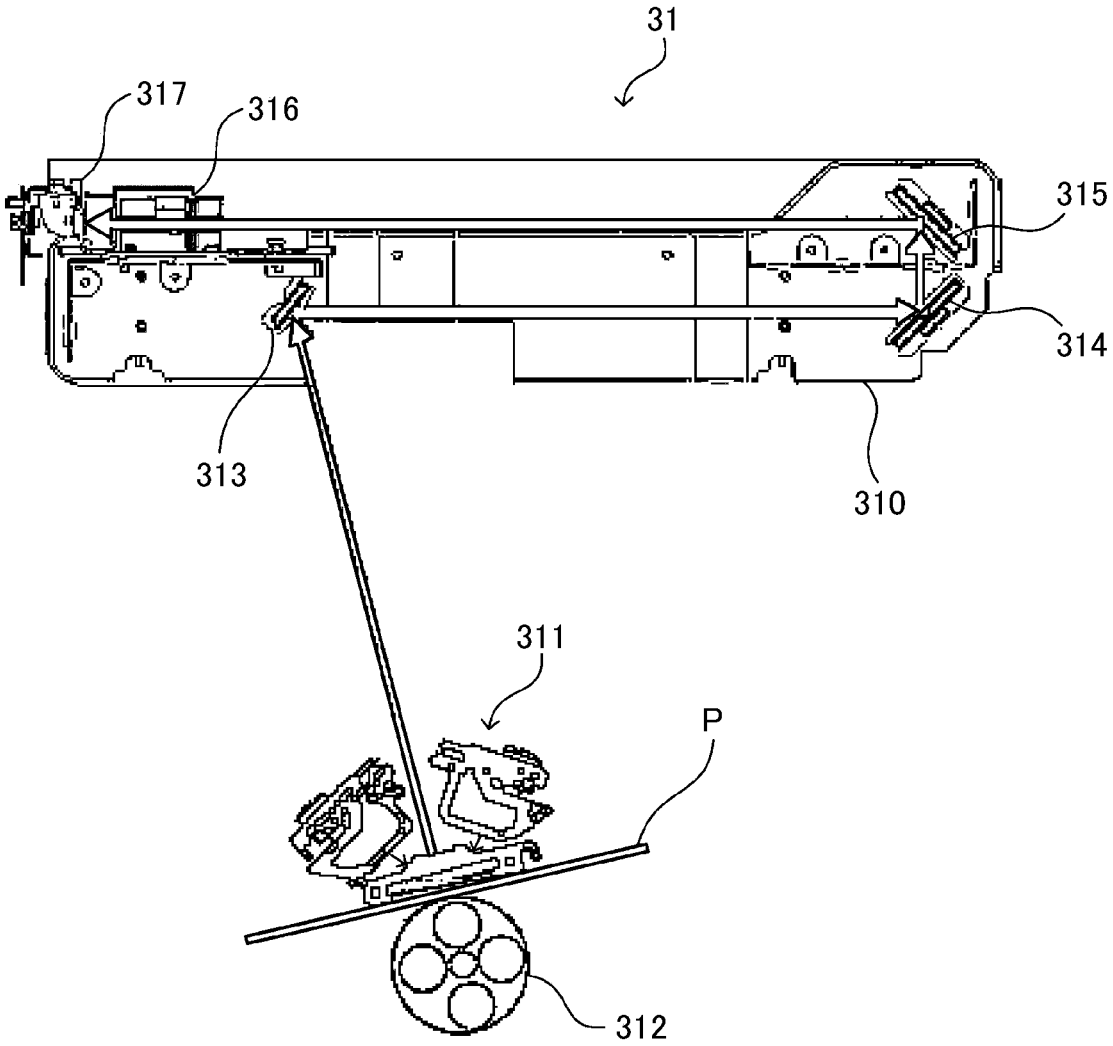
FIG. 7 is a schematic explanatory view of a density detection sensor.

FIG. 7 is a schematic explanatory view of the density detection sensor 31.

The density detection sensor 31 includes a light receiver 310, a light emitter 311, and a density detection shading mechanism 312. The light emitter 311 has two LED arrays. Light emitted from the LED array of the light emitter 311 is reflected at the recording material P, and reflected light enters the light receiver 310. Reflection from the recording material P incident on the light receiver 310 is reflected at a first mirror 313, a second mirror 314, and a third mirror 315 in this order, passes through a lens 316, and is guided to an imaging device 317.

The imaging device 317 is a three-line charge coupled device (CCD) in which a plurality of light receiving elements is arranged in the width direction orthogonal to the conveyance direction of the recording material P. The density detection sensor 31 is an image reading device of a reduction optical system.

Pixels of the color patches forming the density detection mark U transferred on the recording material P are read by the imaging device 317 and device RGB is output as pixel average.

The density detection sensor 31 detects a fixed position, and detects the image density at a predetermined position at predetermined timing, thereby specifying output data from the patch to be density-detected.

Specifically, a distance from the leading end of the recording material P to the position where the density has been detected can be specified by an upstream trigger sensor (the position detection downstream trigger sensor 304 or the like) according to an elapsed time from detection of passage of the leading end of the recording material P to reception of the reflected light. Further, a distance from an end portion in the width direction of the recording material P to the position where the density has been detected can be specified according to the position in the width direction in the imaging device 317, of the light receiver that has received the reflected light.

In a case where the recording material P is skewed or the position in the width direction deviates, the detection data of the density detection sensor 31 is corrected on the basis of a detection result of the position detection sensor 30 capable of detecting positions and inclinations of four sides of the recording material P, and output data from the patch to be density-detected is specified.

The density detection sensor 31 is configured using a reduction optical system but the density detection sensor 31 is not limited to the reduction optical system.

FIGS. 8A to 8D are explanatory views of control of correcting a state in which the width of an image is smaller on the rear end side than on the leading end side of the recording material P.

Figure 8A:
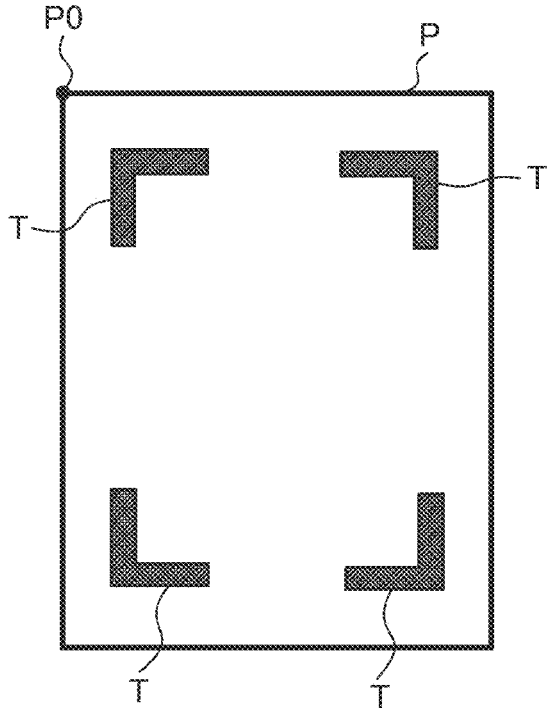
FIGS. 8A to 8D are explanatory views of control of correcting a state in which a width of an image is smaller on a rear end side than a leading end side of a recording material.
Figure 8B:
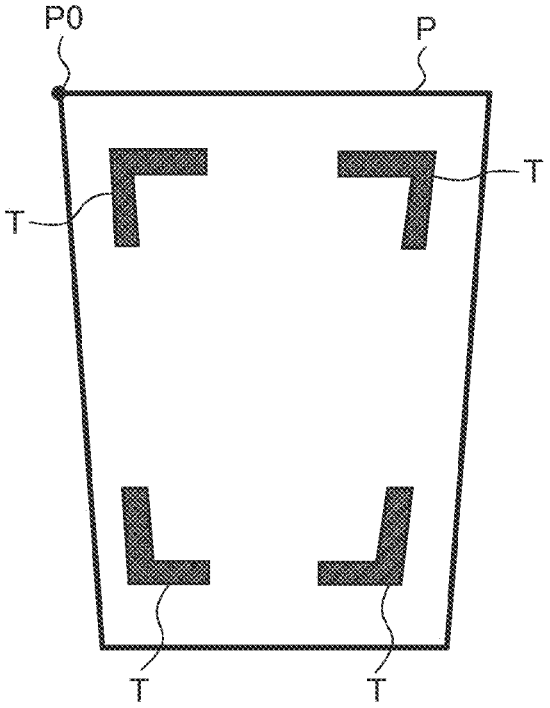
Figure 8C:
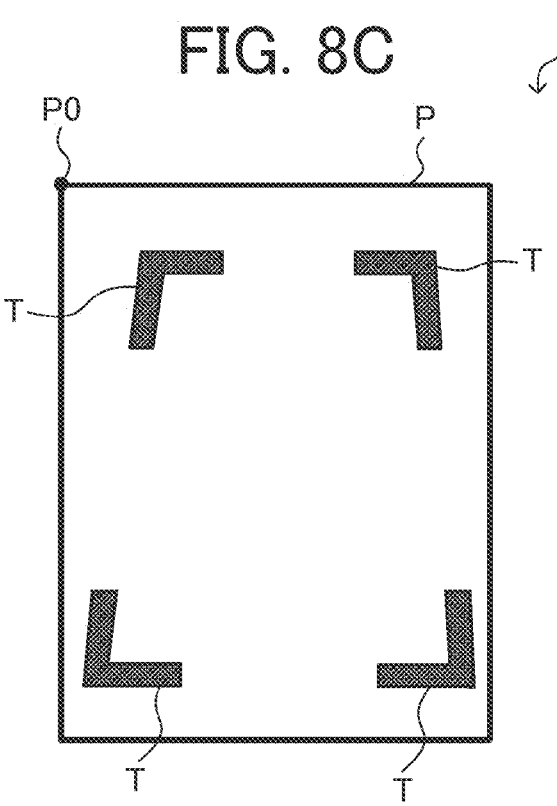
Figure 8D:
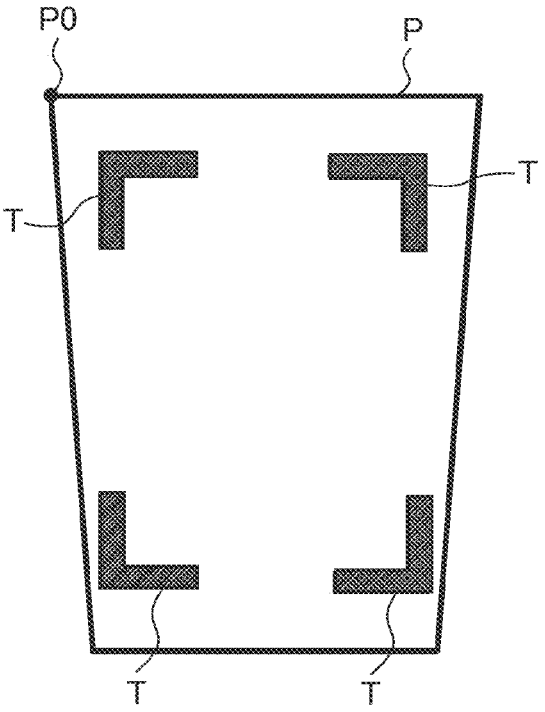

FIG. 8A is an explanatory view of a state of the recording material P to which the position detection mark T before position correction is transferred, and the recording material P before fixed by the fixing device 8, and FIG. 8B is an explanatory view of the recording material P illustrated in FIG. 8A after fixation. FIG. 8C is an explanatory view of the recording material P before fixation on which the position detection mark T is formed under the image forming condition set on the basis of the position detection mark T illustrated in FIG. 8B, and FIG. 8D is an explanatory view of the recording material P illustrated in FIG. 8C after fixation.

In a case where the position detection mark T having a width narrower toward the rear end side of the recording material P is detected as illustrated in FIG. 8B, image formation by the image forming device 7 is controlled to make the width of the image larger than the width of the recording material P toward the rear end side of the recording material P at the time of transfer, as illustrated in FIG. 8C. With the image formation, even when the width on the rear end side of the recording material P becomes narrow due to the thermal contraction at the time of fixation, the position of the position detection mark T with respect to the recording material origin P0 coincides with corresponding predetermined coordinates, as illustrated in FIG. 8D.

In the copying machine 500 of the present embodiment, the registration roller pair 15 corrects the skew and the position in the conveyance direction of the recording material P. Therefore, occurrence of skew in the recording material P entering the secondary transfer nip can be prevented. However, the recording material P is sometimes skewed in the conveyance path R after passing through the secondary transfer nip, and there is a possibility that the recording material P in an inclined state enters the detection regions of the position detection sensor 30 and the density detection sensor 31 of the image information detecting device 300.

Since the position detection sensor 30 of the present embodiment detects the inclinations of the four sides of the recording material P when calculating the recording material origin P0, the inclination of the recording material P in the detection region can be detected. A calculated coordinate axis around the recording material origin P0 is made inclined in accordance with the inclination, whereby image information at predetermined coordinates on the recording material P can be detected.

Further, there is a possibility that the toner image reaching the secondary transfer nip is formed in an inclined state due to an inclination of a member constituting the transfer device 19 due to changes over time or environmental changes, and the toner image is transferred to the recording material P at the secondary transfer nip. In this case, even if the skew of the recording material P is corrected by the registration roller pair 15, the toner image is inclined with respect to the recording material P.

Further, the toner image is inclined with respect to the recording material P in a case where the recording material P having passed through the registration roller pair 15 remains skewed or a case where skew occurs in the conveyance path R from the registration roller pair 15 to the secondary transfer nip.

Figure 9A:
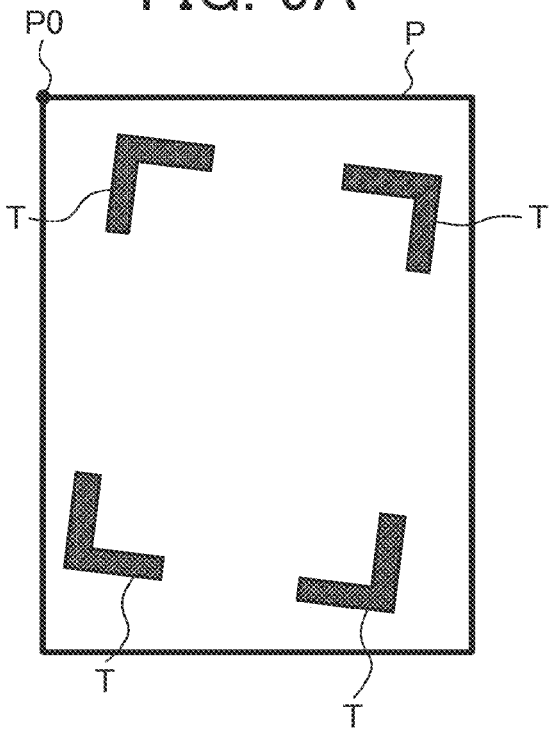
FIGS. 9A and 9B are explanatory views of control of correcting a state in which an image is inclined with respect to a recording material.
Figure 9B:
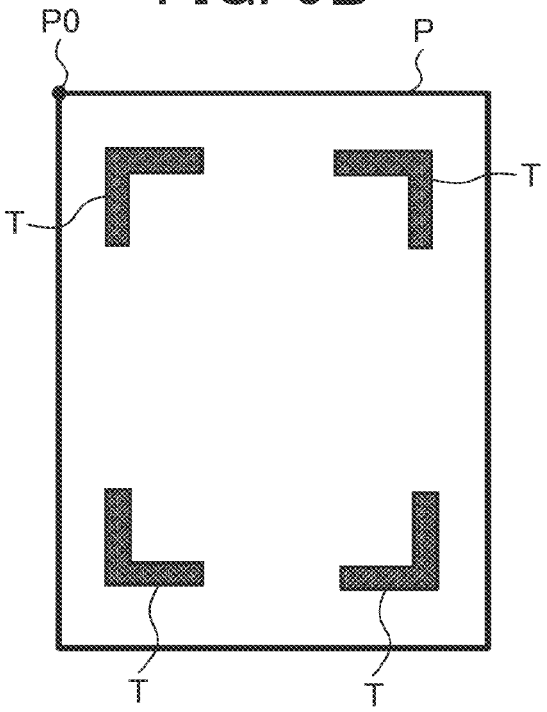

FIGS. 9A and 9B are explanatory views of control of correcting a state in which an image is inclined with respect to a recording material. FIG. 9A is an explanatory view of the recording material P to which the position detection mark T before position correction is transferred, and FIG. 9B is an explanatory view of the recording material P to which the position detection mark T after position correction is transferred.

In the case where the position detection mark T is inclined with respect to the recording material P, as illustrated in FIG. 9A, an image to be formed by the image forming device 7 is inclined to cancel the inclination of the position detection mark T with respect to the recording material P. As a result, the inclination of the toner image with respect to the recording material P can be corrected to obtain the state illustrated in FIG. 9B.

In the electrophotographic image forming apparatus, the print output characteristic changes with the change of the print environment or the progress of printing, and a desired print characteristic (image density) may not be obtained. To solve the disadvantage, there is a color calibration technique of forming an evaluation chart on a recording medium, optically reading the evaluation chart, and performing correction processing regarding an output density characteristic on the basis of a reading result.

However, in the conventional color calibration technique, when reading patches of the evaluation chart printed on the recording medium, the reading has been sometimes affected by deviation of a printing position of the evaluation chart. Due to this influence, an acquired value regarding the image density of the patch to be detected is affected by noise or flare due to the reflected light from surrounding patches, and a desired correction value cannot be obtained in some cases.

As a configuration to perform color calibration, JP-2011-022363-A describes an image forming apparatus that reads an evaluation chart on which mixed color patches are arranged and performs color calibration. The image forming apparatus includes a controller to cause the mixed color patches having the same main component not to be adjacently arranged. This configuration makes the patch to be detected less susceptible to the influence of the adjacent patches at the time of color calibration detection but the position of the patch deviates and this configuration cannot prevent false detection due to detection of the image density of the surrounding patches of the patch to be detected.

Meanwhile, the copying machine 500 of the present embodiment has the configuration including the position detection sensor 30 as a detector that detects the position of the position detection mark T with respect to the recording material origin P0 of the recording material P as a recording medium, separately from the density detection sensor 31 as a color calibration detection optical system. The copying machine 500 reads the density detection mark U as a color calibration evaluation chart by the density detection sensor 31 after feeding back and correcting the printing position of the density detection mark U on the basis of the detection result of the position detection sensor 30. As a result, the copying machine 500 can prevent the false detection of the image density caused by the deviation of the position of the patch with respect to the recording material P, and can read the patches in the density detection mark U with high accuracy.

Figure 10:
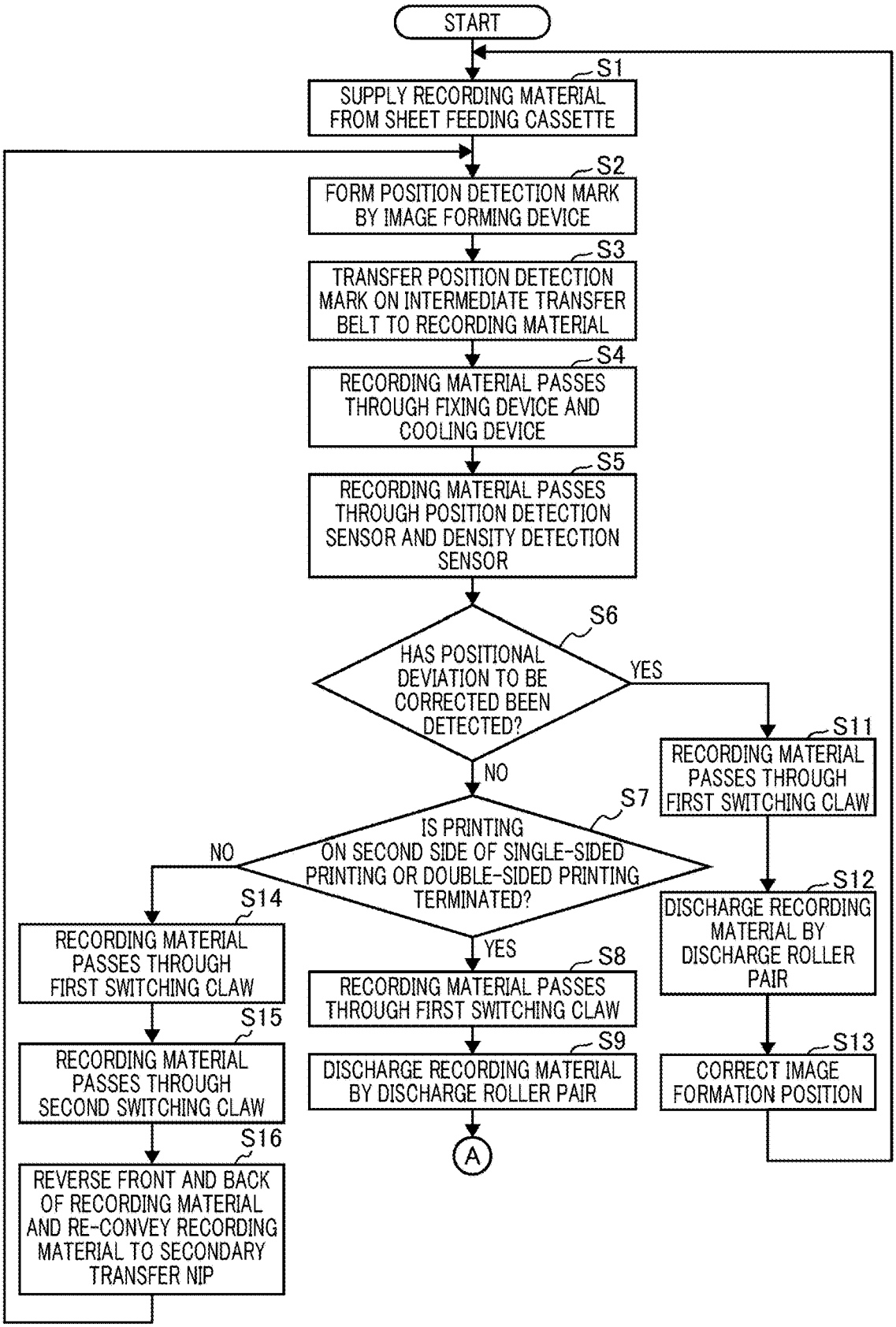
FIG. 10 is a first half of a flowchart of color calibration control in the present embodiment.
Figure 11:
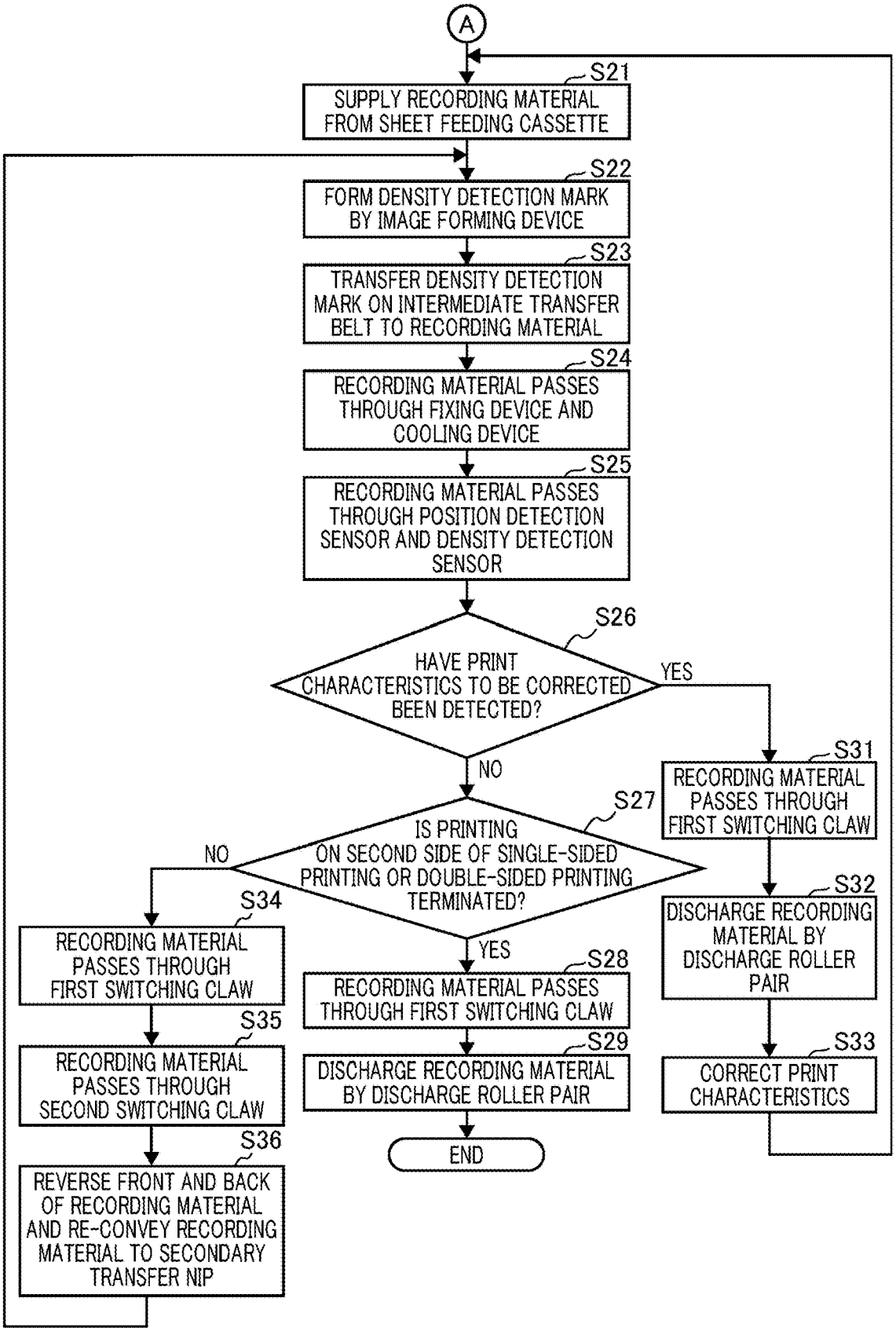
FIG. 11 is a second half of the flowchart of color calibration control in the present embodiment.

FIGS. 10 and 11 are flowcharts of color calibration control in the present embodiment.

First, a case where a printed matter output by a user is single-sided printing will be described.

In the case where a printed matter output by the user is single-sided printing, the position detection mark T and the density detection mark U in the color calibration control are also printed on one side.

The recording material P to be used for printing of the user is supplied from the sheet feeding cassette 13 (S1), the position detection mark T is formed on the intermediate transfer belt 10 by the image forming device 7 (S2), and the position detection mark T on the intermediate transfer belt 10 is transferred to the recording material P (S3). The first recording material P to which the position detection mark T has been transferred undergoes the fixing processing by the fixing device 8 and the cooling processing by the cooling device 9 (S4), and passes through the position detection sensor 30 and the density detection sensor 31 (S5).

The position detection sensor 30 detects the deviation amount (hereinafter called "positional deviation amount" between the printing position of the position detection mark T with respect to the recording material P and an ideal position. Then, the position detection sensor 30 feeds back the positional deviation amount (position detection result) to the control of the image forming device 7 or the like. In a case where the detected positional deviation amount is not a positional deviation amount to be corrected ("No" in S6), the recording material P is the single-sided printing ("Yes" in S7) and is thus ejected as it is (S8 and S9). The recording material P having passed through the position detection sensor 30 passes through the density detection sensor 31 but the recording material P on which the position detection mark T alone is formed is not read by the density detection sensor 31 and is ejected outside the printer 200 by the ejection roller pair 16.

In a case where the detected positional deviation amount is the positional deviation amount to be corrected, for the position detection mark T on the first recording material P ("Yes" in S6), the first recording material P is ejected (S11 and S12) and a second recording material P is supplied from the sheet feeding cassette 13 (S1). With the supply of the second recording material P, the detection result of the first recording material P is fed back, and the position detection mark T in which the image forming condition regarding the printing position has been changed to obtain a desired position is formed on the second recording material P (S2 and S3). Here, examples of the image forming condition regarding the printing position include an image writing position, an inclination of the image, and a magnification of the image.

In a case where the positional deviation to be corrected remains in the formed position detection mark T on the second and subsequent recording materials P, the detection result is fed back, and the position detection mark T in which the image forming condition has been changed to obtain a desired position is formed on the next recording material P.

In a case where the positional deviation to be corrected is not caused in the position detection mark T formed on the recording material P, the recording material P is ejected (S8 and S9), and the image forming condition regarding the printing position is secured and the density detection mark U is formed on the next recording material P (S21, S22, and S23).

The recording material P on which the density detection mark U has been formed undergoes the fixing processing by the fixing device 8 and the cooling processing by the cooling device 9 (S24), and passes through the position detection sensor 30 and the density detection sensor 31 (S25).

An image of the recording material P on which the density detection mark U alone has been formed is not detected by the position detection sensor 30 (the position and inclination in the width direction of the recording material P are detected), and the image density of each of a plurality of color patches formed at predetermined locations on the recording material P is detected by the density detection sensor 31. The controller 50 compares an ideal image density with the detected image density for each of the color patches, and determines whether to correct the print characteristics (the magnitude of developing bias, light writing intensity, and the like). In a case where there are the print characteristics to be corrected ("Yes" in S26), the print characteristics are fed back to the control of the image forming device such as the image forming device 7. In a case where there are no print characteristics to be corrected ("No" in S26), the recording material P is the single-sided printing ("Yes" in S27) and is thus ejected as it is (S28 and S29).

In a case where there are the print characteristics to be corrected for the density detection mark U on the recording material P ("Yes" in S26), the recording material P on which the density detection mark U has been detected is ejected (S31 and S32). With the ejection of the recording material P, the detection result of the density detection mark U is fed back, and the print characteristics are corrected such that each color patch can have a desired image density (S33). The next recording material P is supplied from the sheet feeding cassette 13 (S21), and the density detection mark U with the corrected print characteristics is formed on the next recording material P supplied from the sheet feeding cassette 13 (S22 and S23). In a case where the print characteristics to be corrected have been detected in the formed density detection mark U on the subsequent recording materials P, the detection result is fed back, and the density detection mark U in which the image forming condition has been changed to obtain a desired image density is formed on the next recording material P.

In a case where the print characteristics to be corrected have not been detected in the density detection mark U formed on the recording material P ("No" in S26), the recording material P is ejected (S28 and S29), and the color calibration control is terminated.

After the termination of the color calibration control, the printed matter requested by the user is output. In this case, in a case of production printing, it is common to leave a margin around a print image to be used as a final printed matter on the recording material P and to trim the margin of the output printed matter. In the case where there is a margin to be trimmed at the end as described above, the position detection mark T may be formed on the margin of the printed matter of the user. The position detection mark T is detected by the position detection sensor 30, and the position of the image is corrected on the basis of the detection result of the position detection mark T while the printed matter of the user is continuously output, whereby occurrence of the positional deviation of the image can be prevented at the time of continuous printing.

Further, in a case where there is no margin to be trimmed at the end, the position detection mark T is printed on the recording material P and is detected by the position detection sensor 30, and the position of the image may be corrected, in each printing of a predetermined number of sheets during continuous printing. In this case, the recording material P after detection is desirably ejected to a ejection tray in which the recording material P is distinguishable from the printed matter of the user.

Next, a case where the printed matter output by the user is double-sided printing will be described. In the case where the printed matter output by the user is double-sided printing, surface characteristics of the recording material P may be different between the first side and the second side of the recording material P, or the surface characteristics of the recording material P may be different in forming an image on the second side from in forming an image on the first side due to the fixing processing performed once. Therefore, in the case where the printed matter output by the user is double-sided printing, the position detection mark T and the density detection mark U in the color calibration control are also desirably printed on both sides.

In the case of double-sided printing, processing from transferring the position detection mark T on the first side to detecting the positional deviation amount is the same as the processing of single-sided printing (S1 to S5). Further, in a case where the detected positional deviation amount is the positional deviation amount to be corrected, for the position detection mark T formed on the second side of the recording material P ("Yes" in S6), the recording material P is ejected without forming the position detection mark T on the second side (S11 and S12). Then, the next recording material P is supplied from the sheet feeding cassette 13 (S1). Control in a case where the positional deviation to be corrected is detected is similar as in the single-sided printing (S11 to S13 and S1 to S6).

In a case where the detected positional deviation amount is not the positional deviation amount to be corrected ("No" in S6), the first switching claw 25*a* and the second switching claw 25*b* are switched in the case where the position detection mark T is formed on the first side alone of the double-sided printing. Then, the recording material P is brought to pass through the first switching claw 25*a* and the second switching claw 25*b* (S14 and S15), the front and back sides of the recording material P are reversed, the recording material P is re-conveyed to the secondary transfer nip, and the position detection mark T is transferred to the second side (S2 and S3). In the case where the positional deviation to be corrected is caused in the position detection mark T on the second side, the recording material P is ejected, the position detection mark T is transferred to the first side of the next recording material P, and feedback control is performed until the positional deviation to be corrected is gone from the position detection marks T on the first side and the second side.

When the positional deviation to be corrected has been gone from the position detection marks T on both sides, the density detection mark U is transferred to the next recording material P, and the feedback control is performed until the print characteristics to be corrected become undetected on both sides (S21 to S29 and S31 to S36). In a case where the print characteristics to be corrected have not been detected in the density detection mark U on both sides of the recording material P, the recording material P is ejected (S28 and S29), and the color calibration control is terminated.

After the termination of the color calibration control, the position detection mark T may be formed on a margin of a printed matter requested by the user or on the recording material P of each printing of a predetermined number of sheets, similarly to the single-sided printing. Since the position detection mark T is used to prevent occurrence of the positional deviation in the image at the time of continuous printing, the position detection mark T may be formed on one side even at the time of double-sided printing.

In the present embodiment, in the case where the printed matter output by the user is double-sided printing, the position detection mark T and the density detection mark U in the color calibration control are also desirably printed on both sides. However, in the case where the printed matter output by the user is double-sided printing, the position detection mark T and the density detection mark U in the color calibration control may be printed on one side. In the above configuration, the image forming condition on the second side of the printed matter of the user is corrected on the basis of image information detected by printing the position detection mark T and the density detection mark U on the first side.

The copying machine 500 of the present embodiment detects the image information and repeatedly corrects the image forming condition based on the detection result, thereby performing the color calibration with higher accuracy, as described with reference to FIGS. 10 and 11.

<Modification>

Next, a modification in which a position detection mark T and a density detection mark U are formed on one sheet of recording material P will be described.

Figure 12:
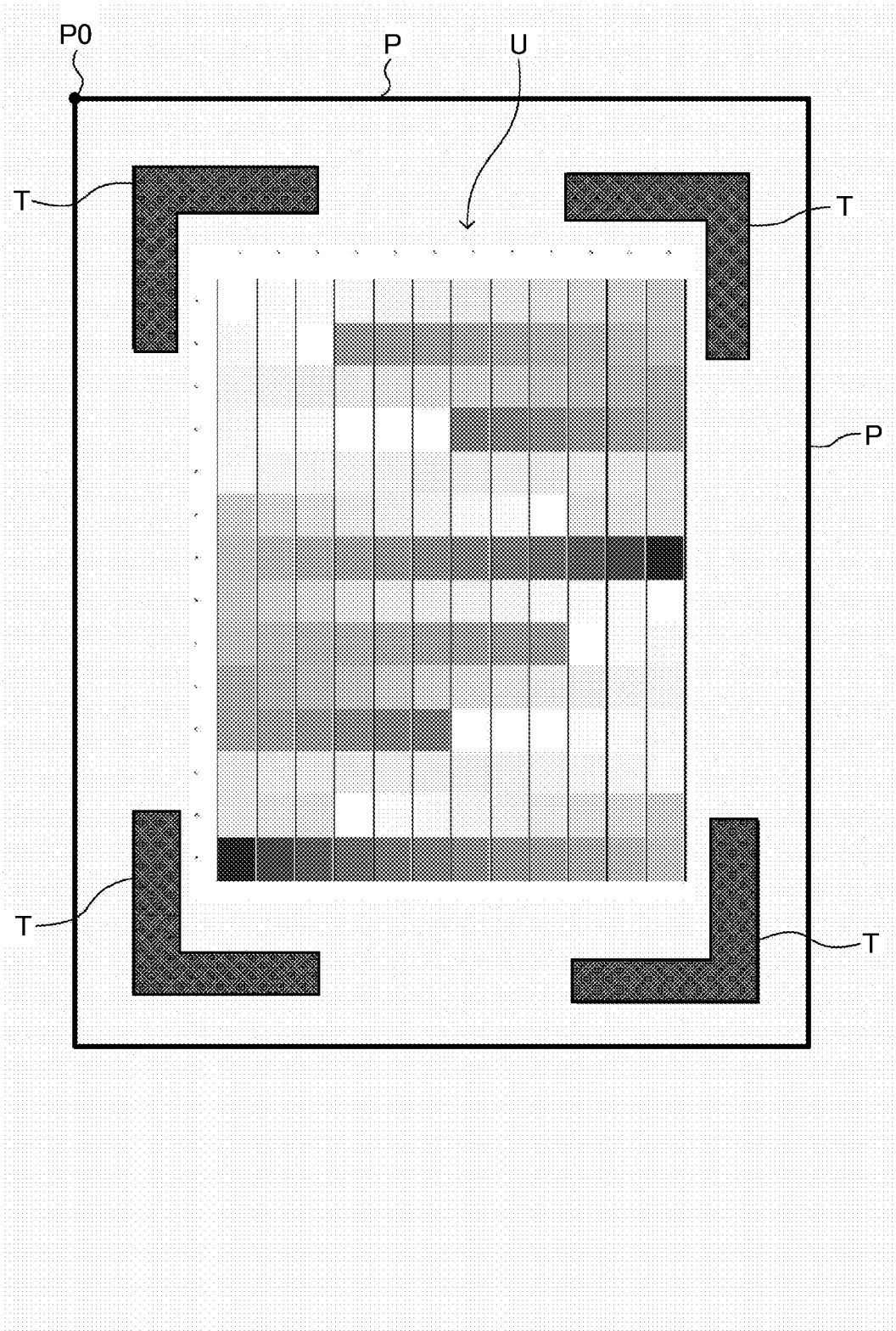
FIG. 12 is an explanatory view of an image information detection image formed on a recording material according to a modification.

FIG. 12 is an explanatory view of an image information detection image formed on a recording material P according to the modification. The modification has a similar configuration to the copying machine 500 of the above embodiment except that an image information detection image formed on a recording material P and control using the image information detection image are different.

As illustrated in FIG. 12, in the modification, four position detection marks T are formed outside a square of the density detection mark U. The position detection marks T and the density detection mark U of the modification are a toner image similar to the position detection mark T and the density detection mark U of the embodiment except that the size of the density detection mark U with respect to the recording material P is smaller than the density detection mark U in the embodiment illustrated in FIG. 4B.

In the modification, the position detection marks T at unchanged positions relative to the density detection mark U are printed on the one sheet of recording material P together with the density detection mark U. Then, in a case where positional deviation is caused in the position detection marks T with respect to the recording material P, an image forming condition is corrected to eliminate the positional deviation in the position detection marks T, whereby the position of the density detection mark U with respect to the recording material P can be corrected.

Figure 13:
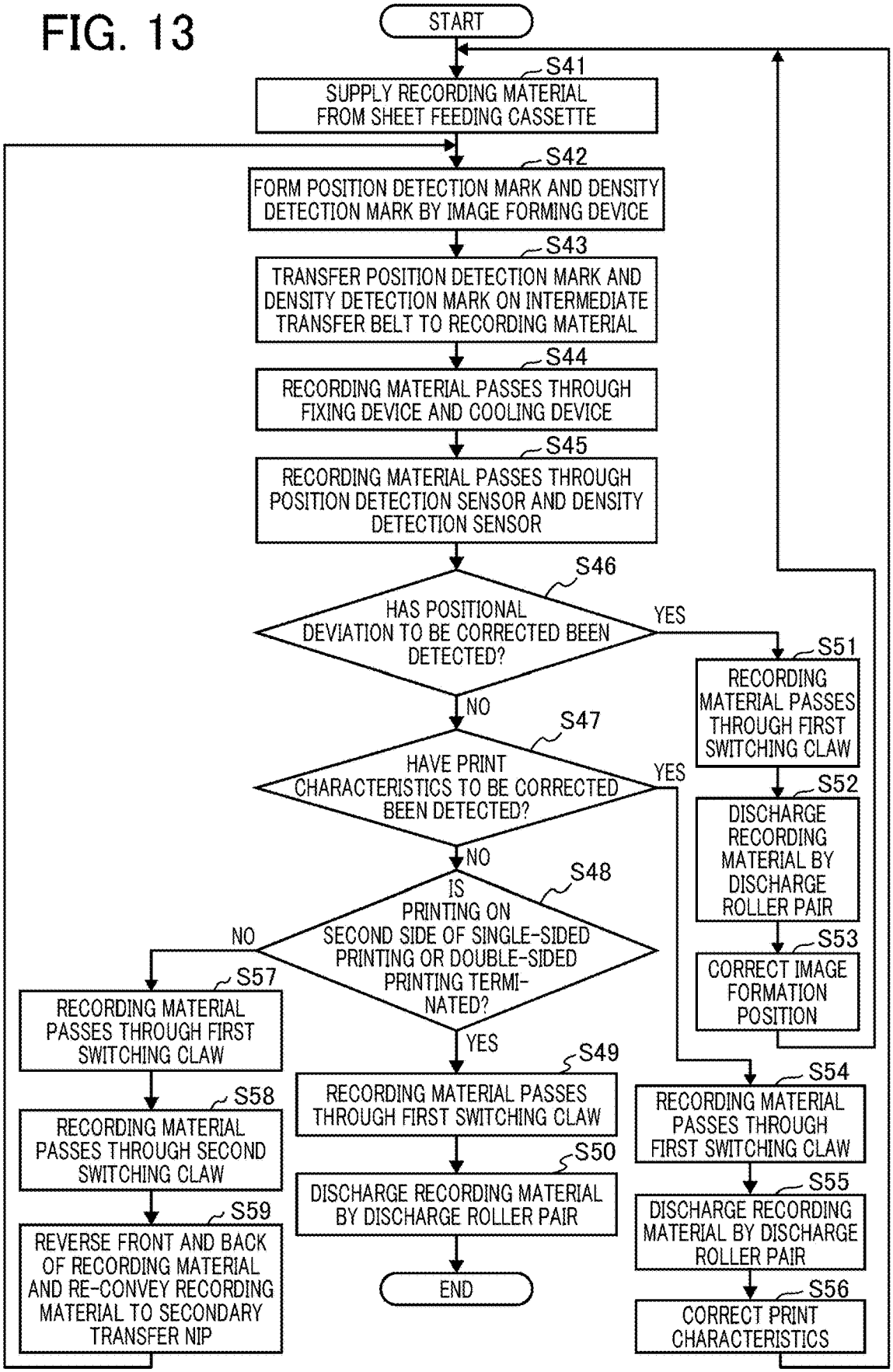
FIG. 13 is a flowchart of color calibration control in the modification.

FIG. 13 is a flowchart of color calibration control in the modification.

The recording material P to be used for printing of a user is supplied from a sheet feeding cassette 13 (S41), and the image information detection image including the position detection marks T and the density detection mark U illustrated in FIG. 12 is formed on an intermediate transfer belt 10 by an image forming device 7 (S42). Then, the image information detection image on the intermediate transfer belt 10 is transferred to the recording material P (S43). The first recording material P to which the image information detection image has been transferred undergoes fixing processing by a fixing device 8 and cooling processing by a cooling device 9 (S44), and passes through a position detection sensor 30 and a density detection sensor 31 (S45).

The position detection sensor 30 detects a positional deviation amount of the position detection mark T with respect to the recording material P, and feeds back the positional deviation amount to control of an image forming device such as the image forming device 7. Further, the density detection sensor 31 detects an image density of each of color patches of the density detection mark U, and feeds back the image density to the control of the image forming device such as the image forming device 7. In a case where the positional deviation amount is not a positional deviation amount to be corrected ("No" in S46), there are no print characteristics to be corrected ("No" in S46), and in a case of single-sided printing ("Yes" in S48), the recording material P is ejected as it is (S49 and S50) and the color calibration control is terminated. In a case where printing on the second side of the double-sided printing is terminated ("Yes" in S48), the recording material P is ejected (S49 and S50), and the color calibration control is terminated.

In a case where the detected positional deviation amount is the positional deviation amount to be corrected, for the position detection mark T on the first recording material P ("Yes" in S46), the first recording material P is ejected (S51 and S52) and a second recording material P is supplied from the sheet feeding cassette 13 (S1). With the supply of the second recording material P, the detection result of the first recording material P is fed back, and the position detection mark T and the density detection mark U in which the image forming condition regarding the printing position has been changed to obtain a desired position are formed on the second recording material P (S42 and S43). In a case where the positional deviation to be corrected remains in the formed position detection mark T on the second and subsequent recording materials P, the detection result is fed back, and the position detection mark T and the density detection mark U in which the image forming condition has been changed to obtain a desired position are formed on the next recording material P.

In a case where the positional deviation to be corrected is not caused in the position detection mark T formed on the recording material P ("No" in S46), and in a case where there are the print characteristics to be corrected ("Yes" in S46), the recording material P on which the density detection mark U has been detected is ejected (S54 and S55). With the ejection of the recording material P, the detection result of the density detection mark U is fed back, and the print characteristics are corrected such that each color patch can have a desired image density (S56). The next recording material P is supplied from the sheet feeding cassette 13 (S41), and the position detection mark T in the same image forming condition as the previous recording material P and the density detection mark U with the corrected print characteristics are formed on the next recording material P supplied from the sheet feeding cassette 13 (S42 and S43). In a case where the print characteristics to be corrected have been detected in the formed density detection mark U on the subsequent recording materials P, the detection result is fed back, and the density detection mark U in which the image forming condition has been changed to obtain a desired image density is formed on the next recording material P.

In a case where the positional deviation amount is not the positional deviation amount to be corrected ("No" in S46) and there are no print characteristics to be corrected ("No" in S46), and the image information detection image is formed on the first side alone of the double-sided printing, a first switching claw 25*a* and a second switching claw 25*b* are switched. Then, the recording material P is brought to pass through the first switching claw 25*a* and the second switching claw 25*b* (S57 and S58), front and back sides of the recording material P are reversed, the recording material P is re-conveyed to a secondary transfer nip, and the image information detection image including the position detection mark T and the density detection mark U is transferred on the second side (S42 and S43). In a case where the positional deviation to be corrected and the print characteristics to be corrected are detected in the image information detection image on the second side, the recording material P is ejected, and the image information detection image is transferred to the first side of the next recording material P. Then, feedback control is performed until the positional deviation to be corrected and the print characteristics to be corrected become undetected in the image information detection images on the first side and the second side.

A copying machine 500 of the modification detects the image information and repeatedly corrects the image forming condition based on the detection result, thereby performing the color calibration with higher accuracy, as described with reference to FIG. 13.

After the termination of the color calibration control, the position detection mark T may be formed on a margin of a printed matter requested by the user or on the recording material P of each printing of a predetermined number of sheets, similarly to the above-described embodiment.

In the above modification, after confirming that the position detection mark T has been formed at an appropriate position ("No" in S46), the image density of each color patch of the density detection mark U is compared with a desired image density, and necessity of correction of the print characteristics is determined (S47). In the configuration to output the position detection mark T and the density detection mark U on one sheet of recording material P as in the modification, the position information of each color patch of the density detection mark U can be corrected on the basis of the information of the positional deviation even when the positional deviation to be corrected is caused. As a result, the necessity of correction of the print characteristics based on the detection result of the density detection mark U can be determined even when the positional deviation is caused.

In the case of the configuration to correct the position information of the color patch, the necessity of correction of the print characteristics is determined on the basis of the detection result of the density detection mark U even when the positional deviation to be corrected is caused in the position detection mark T on the first recording material P. Then, when forming the position detection mark T and the density detection mark U on the second recording material P, the image formation on the second recording material P is performed with the desired position and print characteristics on the basis of a position detection result and a print characteristic result fed back from the first recording material P. The image information of the position detection mark T and the density detection mark U is detected and feedback control based on the detected image information is performed for the second and subsequent recording materials P, similarly to the first sheet.

In the configuration of the modification, in a case where the position detection mark T and the density detection mark U are formed on one sheet of recording material P, and correction of the positional deviation and correction of the print characteristics are not required, the one sheet of recording material P used in the color calibration control is sufficient. Therefore, the number of the recording materials P consumed in the color calibration control can be reduced as compared with the configuration of the above embodiment in which the position detection mark T and the density detection mark U are formed on different recording materials P, and the number of the recording materials P required for the color calibration control is two or more. In addition, there is an advantage that the reliability of the detection accuracy of the density detection mark U is increased because the density detection mark U on the recording material P on which the position of the position detection mark T being in an appropriate state is detected.

Meanwhile, the copying machine 500 of the embodiment forms the density detection mark U after confirming that the position detection mark T has been formed at an appropriate printing position, and therefore can prevent formation of the density detection mark U not used for density detection and prevent consumption of the toners.

Further, characteristics of thermal contraction may differ depending on the type of the recording material P or conditions of an installation environment (such as the temperature and humidity), and the positional deviation of an image due to the thermal contraction is more likely to occur in a case where the type of the recording material P on which an image is formed is changed or in a case where an image is formed for the first time of the day. Therefore, at the time of initial adjustment of the density in the case where the type of the recording material P on which an image is formed is changed or in the case where an image is formed for the first time of the day, it is desirable to feed back the detection result of the position detection mark T once before transfer of the density detection mark U. In such a case, the configuration to output the position detection mark T and the density detection mark U on different recording materials P is suitable as in the embodiment.

The image forming system including the image forming apparatus such as the copying machine 500 of the embodiment or the modification may have a configuration including a plurality of ejection trays on a downstream side of the ejection roller pair 16, and a recording material processing device capable of selecting a sheet ejection destination. In such a configuration, the ejection destination of the recording material P on which the position detection mark T and the density detection mark U are formed is desirably an ejection tray called proof tray arranged on a top of the recording material processing device and easily recognized by the user. With the ejection tray, the user can easily recognize that the recording material on which the detection marks are formed has been ejected, and mixture of the recording material P on which the detection marks such as the position detection mark T and the density detection mark U alone are formed with the recording material P on which an image that the user wishes to output is formed can be suppressed.

The image information detecting device 300 of the copying machine 500 of the above embodiment and modification has the position detection sensor 30 located on the upstream side of the density detection sensor 31. However, either of the position detection sensor 30 and the density detection sensor 31 may be arranged on the upstream side. By arranging the position detection sensor 30 on the upstream side, the detection operation of the image on the recording material P by the density detection sensor 31 can be stopped at the point of time when the positional deviation to be corrected is detected in the position detection sensor 30, and an operation load of the density detection sensor 31 can be decreased.

In the above embodiment and modification, a case in which the image bearer on which the image information detection image detected by the image information detecting device 300 as the image density detector is formed is the recording medium (recording material P) has been described. The image bearer on which the image information detection image detected by the image information detecting device including the image density detector and the image position detector is formed is not limited to the recording medium. The image bearer may be a latent image bearer such as the photoconductor 2 or an intermediate transfer member such as the intermediate transfer belt 10.

In these members, positional deviation of the density detection image is less likely to occur as compared with the recording medium. However, there is a possibility that positional deviation between the members may occur due to component errors, assembly errors, changes over time, or environmental changes, and positional deviation of the density detection image with respect to the image bearer may occur due to the positional deviation between members. With the image position detector that detects the position of the image on the image bearer, false detection of the image density caused by the positional deviation of the density detection image can be prevented even when such positional deviation occurs.

However, even if the image density is controlled to be a desired image density on the surface of these image bearers, there is a possibility that the image density varies depending on variation of a transfer rate caused by deterioration over time and environmental variation in the process up to transfer of the image with an adjusted image density from the image bearer to the recording medium. In contrast, the density detection image is formed on the recording medium and fed back as in the present embodiment, whereby the image density on the recording medium that is a final output matter can be adjusted and a printed matter with an appropriate image density can be output.

The "recording medium" that carries the image of which the image information is detected by the image information detecting device according to the embodiment of the present disclosure includes paper, coated paper, OHP sheet, label paper, film, cloth, and the like.

The arrangement of the image information detecting device 300 is not limited to the downstream side of the fixing device 8 and the cooling device 9 in the conveyance direction of the recording material P as long as the arrangement is on a downstream side in the conveyance direction with respect to the recording material transfer position (secondary transfer nip) where the image is transferred to the recording material P. By detecting the image information of the image of the recording material P after the fixation and cooling as in the present embodiment, the positional deviation caused by the fixation and cooling such as the thermal contraction can be corrected.

Further, the image information detecting device 300 may be arranged near the ejection roller pair 16. However, by arranging the image information detecting device 300 between the fixing device 8 and the first switching claw 25*a*, the image information of the recording material P before reaching the branching position between the ejection conveyance path R1 guiding the recording material P toward the ejection roller pair 16 and the retransfer conveyance path R2 guiding the recording material P to the secondary transfer nip again can be acquired. With the configuration, formation of the image information detection image on the second side and detection of the image information can be performed after detecting the image information detection image on the first side at the double-sided printing.

Further, the image forming apparatus that prints the position detection image such as the position detection mark T and the density detection image such as the density detection mark U on the recording medium such as the recording material P is not limited to the electrophotographic image forming apparatus such as the copying machine 500. An image forming apparatus based on another method such as an inkjet method may be used.

The above description is merely an example, and specific effects are exerted in each of the following aspects.

(Aspect 1)

An image information detecting device such as the image information detecting device 300 including an image density detector such as the density detection sensor 31 to detect an image density of an image such as the density detection mark U on a surface of an image bearer such as the recording material P, the image information detecting device including an image position detector such as the position detection sensor 30 to detect a position of an image such as the position detection mark T on the image bearer.

According to this configuration, in a case where the position of the image with respect to the image bearer deviates from a desired position, the deviation of the position of the image can be detected by the image position detector, as described in the above embodiments. In the case where the deviation of the position of the image is detected, a detection result of the image density by the image density detector is not used or position information of the image of which the image density has been detected is corrected according to the deviation of the position of the image. As a result, false detection of the image density caused by the deviation of the position of the image with respect to the image bearer can be prevented.

(Aspect 2)

In the aspect 1, the image density detector and the image position detector detect the image density and the position of an image on the surface of the image bearer, the image passing through respective detection regions, and the detection region of the image position detector is located on an upstream side in a moving direction (such as a conveyance direction of the recording material P) of the image bearer with respect to the detection region of the image density detector.

According to the configuration, an operation load of the image density detector can be decreased, as described in the above embodiments.

(Aspect 3)

An image forming apparatus such as the copying machine 500 including an image forming device such as the image forming device 7 and the transfer device 19 to form an image on a surface of an image bearer such as the recording material P, an image information detector such as the image information detecting device 300 to detect image information of the image on the surface of the image bearer, and an image forming condition controller such as the controller 50 to control an image forming condition by the image forming device on the basis of a detection result of the image information detector, in which the image information detecting device according to the aspect 1 or 2 is included as the image density detector, and the image formation controller controls the image forming condition on the basis of detection results of the image position detector and the image density detector.

According to the configuration, the image forming condition is controlled on the basis of the detection result of the position detector, whereby the image of which the image density is to be detected by the image density detector can be formed at a predetermined position on the image bearer, as described in the above embodiments. The image formed at the predetermined position is detected by the image density detector, whereby false detection of the image density caused by deviation of the position of the image with respect to the image bearer can be prevented, and the image density of the image to be detected can be detected. The image forming condition is controlled on the basis of the detection result of the image density detector with the configuration to prevent the false detection, whereby image formation can be performed with a desired density, and the image quality can be improved.

(Aspect 4)

In the aspect 3, the image forming device forms an image on a recording medium such as the recording material P as the image bearer, and the image density detector detects the image density on a surface of the recording medium.

According to the configuration, the image density on the recording medium that is a final output matter is adjusted, whereby a printed matter with an appropriate image density can be output, as described in the above embodiments.

(Aspect 5)

In the aspect 4, a transfer device such as the transfer device 19 to transfer an image to the recording medium and a fixing device such as the fixing device 8 to heat the recording medium to which the image has been transferred by the transfer device to fix the image are further included, in which the image information detecting device is located on a downstream side in a conveyance direction of the recording medium with respect to the fixing device.

According to the configuration, the positional deviation of the image with respect to the recording medium, which is caused by the fixation such as thermal contraction, can be corrected, as described in the above embodiments.

(Aspect 6)

In Aspect 5, the image information detecting device is located on an upstream side in the conveyance direction of the recording medium with respect to a branching position between an ejection conveyance path such as the ejection conveyance path R1 guiding the recording medium having passed through the fixing device outside the apparatus and a retransfer conveyance path such as the retransfer conveyance path R2 guiding the recording medium having passed through the fixing device to a transfer portion (such as a secondary transfer nip) by the transfer device.

According to the configuration, correction of the image forming condition for the deviation of the position of the image with respect to the recording medium and correction of the image forming condition in a case where the image density is inappropriate can be similarly performed at the time of single-sided printing and at the time of double-sided printing, as described in the above embodiments.

(Aspect 7)

In the aspect 5 or 6, a cooling device such as the cooling device 9 located on a downstream side in the conveyance direction of the recording medium with respect to the fixing device and to cool the recording medium is included, in which the image information detecting device is located on a downstream side in the conveyance direction of the recording medium with respect to the cooling device.

According to the configuration, the positional deviation of the image with respect to the recording medium, which is caused by the fixation and cooling such as thermal contraction, can be corrected, as described in the above embodiments.

(Aspect 8)

In any one of the aspects 3 to 7, the image forming device forms a density detection image such as the density detection mark U and a position detection image such as the position detection mark T on the surface of the image bearer.

According to the configuration, a configuration to detect the position of the image on the image bearer by the image position detector and to detect the density of the image on the image bearer by the image density detector, and to correct the image forming condition on the basis of detection results can be implemented, as described in the above embodiments.

(Aspect 9)

In the aspect 8, the image forming device forms the position detection image outside a region where an output image is formed on the surface of the image bearer (in a margin of a printed matter of a user, or the like).

According to the configuration, the position of the image is corrected on the basis of the detection result of the position detection image while the output image is continuously output, whereby deviation of the position of the image can be prevented during continuous printing, as described in the above embodiments.

Although some embodiments of the present disclosure have been described above, the above-described embodiments are presented as examples, and are not intended to limit the scope of the invention. The above-described embodiments can be implemented in various other forms, and various omissions, substitutions, changes, and combinations can be made without departing from the gist of the invention. Such embodiments and variations thereof are included in the scope and gist of the invention and are included in the invention described in claims and the equivalent scope thereof.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. An image forming apparatus comprising:

an image forming device to form an image on a surface of a recording medium;

an image position detector to detect a position of the image; and an image density detector to detect a density of the image, wherein the image forming device forms a position detection image on a surface of a first recording medium, the image position detector detects a position of the position detection image on the surface of the first recording medium, the image forming device forms a density detection image on a surface of a second recording medium, and the image density detector detects a density of the density detection image on the surface of the second recording medium, wherein the position detection image is formed on only one side of the first recording medium, without forming an image on another side of the first recording medium, the image forming apparatus further comprising an image forming condition controller to control an image forming condition of the image forming device, wherein the image forming condition controller changes the image forming condition on an image forming position according to a detection result of the density detection image on the surface of the first recording medium detected with the image position detector and causes the image forming device to form the density detection image onto the surface of the second recording medium according to the image forming condition changed.

2. The image forming apparatus according to claim 1, wherein the image position detector detects the position of the position detection image on the surface of the first recording medium when the first recording medium passes through a detection region of the image position detector, wherein the image density detector detects the density of the density detection image on the surface of the second recording medium when the second recording medium passes through a detection region of the image density detector, and wherein the detection region of the image position detector is located upstream from the detection region of the image density detector in a conveyance direction of the first recording medium and the second recording medium.

3. The image forming apparatus according to claim 1, further comprising:

a transfer device to transfer an image onto the recording medium; and a fixing device to heat the recording medium on which the image has been transferred by the transfer device, to fix the image on the recording medium, wherein the image position detector and the image density detector are located downstream from the fixing device in a conveyance direction of the recording medium.

4. The image forming apparatus according to claim 3, further comprising:

an ejection conveyance path to guide the recording medium having passed the fixing device to an outside of the image forming apparatus; and a retransfer conveyance path to guide the recording medium having passed the fixing device to a transfer portion at which the transfer device transfers the image on the recording medium, wherein the image position detector and the image density detector are located upstream from a branching position between the ejection conveyance path and the retransfer conveyance path in the conveyance direction of the recording medium.

5. The image forming apparatus according to claim 3, further comprising a cooling device located downstream from the fixing device in the conveyance direction of the recording medium, to cool the recording medium, wherein the image position detector and the image density detector are located downstream from the cooling device in the conveyance direction of the recording medium.

6. The image forming apparatus according to claim 1, wherein the image forming device forms the position detection image outside a region in which an output image is formed on the surface of the recording medium.

7. The image forming apparatus according to claim 1, wherein the image forming device forms only the position detection image on the surface of the first recording medium and only the density detection image on the surface of the second recording medium.

8. The image forming apparatus according to claim 1, wherein the image forming device forms the position detection image and also the density detection image on the surface of the first recording medium, and forms the density detection image and also the position detection image on the surface of the second recording medium.

9. The image forming apparatus according to claim 8, wherein the image forming device forms the position detection image outside a square of the density detection image on the surface of each of the first recording medium and the second recording medium.

10. The image forming apparatus according to claim 1, wherein the second recording medium is conveyed subsequently to the first recording medium.

11. An image forming apparatus comprising:

an image forming device to form an image on a surface of a recording medium;

an image position detector to detect a position of the image; and an image density detector to detect a density of the image, wherein the image forming device forms a position detection image on a surface of a first recording medium, the image position detector detects a position of the position detection image on the surface of the first recording medium, the image forming device forms a density detection image on a surface of a second recording medium, and the image density detector detects a density of the density detection image on the surface of the second recording medium, wherein the image position detector includes an image reading device of an equal magnification optical system, and wherein the image density detector includes an image reading device of a reduction optical system.

12. An image forming method comprising:

forming a position detection image on a surface of a first recording medium with an image forming device;

detecting a position of the position detection image on the surface of the first recording medium with an image position detector;

forming a density detection image on a surface of a second recording medium with the image forming device; and detecting a density of the density detection image on the surface of the second recording medium with an image density detector, wherein the position detection image is formed on only one side of the first recording medium, without forming an image on another side of the first recording medium, the method further comprising:

changing the image forming condition on an image forming position according to a detection result of the density detection image on the surface of the first recording medium detected with the image position detector and causes the image forming device to form the density detection image onto the surface of the second recording medium according to the image forming condition changed.

13. The method according to claim 12, wherein the detecting the position of the position detection image detects the position of the position detection image on the surface of the first recording medium when the first recording medium passes through a detection region of the image position detector, wherein the image density detector detects the density of the density detection image on the surface of the second recording medium when the second recording medium passes through a detection region of the image density detector, and wherein the detection region of the image position detector is located upstream from the detection region of the image density detector in a conveyance direction of the first recording medium and the second recording medium.

14. The method according to claim 12, wherein the forming the position detection image forms the position detection image outside a region in which an output image is formed on the surface of an output image recording medium.

15. The method according to claim 12, wherein the forming the position detection image forms only the position detection image on the surface of the first recording medium and the forming a density detection image forms only the density detection image on the surface of the second recording medium.

16. The image forming apparatus according to claim 12, wherein the forming the position detection image and the forming a density detection image form the position detection image and also the density detection image on the surface of the first recording medium, and form the density detection image and also the position detection image on the surface of the second recording medium.

* * * * *